US010332437B2

(12) United States Patent
Orio et al.

(10) Patent No.: US 10,332,437 B2
(45) Date of Patent: Jun. 25, 2019

(54) METHOD AND DEVICE FOR DISPLAY COLOR ADJUSTMENT

(71) Applicant: Synaptics Japan GK, Tokyo (JP)

(72) Inventors: Masao Orio, Tokyo (JP); Hirobumi Furihata, Tokyo (JP); Susumu Saito, Tokyo (JP); Takashi Nose, Tokyo (JP); Akio Sugiyama, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 141 days.

(21) Appl. No.: 15/592,688

(22) Filed: May 11, 2017

(65) Prior Publication Data

US 2017/0330498 A1 Nov. 16, 2017

(30) Foreign Application Priority Data

May 13, 2016 (JP) ..... 2016-096978

(51) Int. Cl.
*G09G 5/10* (2006.01)
*G09G 3/20* (2006.01)

(52) U.S. Cl.
CPC ..... *G09G 3/2003* (2013.01); *G09G 5/10* (2013.01); *G09G 2320/0666* (2013.01)

(58) Field of Classification Search
CPC ..... G09G 3/3648; G09G 2320/0242; G09G 2320/0666; G09G 2340/06; G09G 5/10; G09G 3/2003
See application file for complete search history.

(56) References Cited

U.S. PATENT DOCUMENTS 5,309,257 A * 5/1994 Bonino ..... H04N 1/6052 345/590
2004/0150602 A1* 8/2004 Furukawa ..... G09G 3/3688 345/98
2006/0139368 A1* 6/2006 Kinoshita ..... G09G 3/3208 345/590
2007/0279372 A1* 12/2007 Brown Elliott ..... G09G 3/3426 345/102

(Continued)

FOREIGN PATENT DOCUMENTS

JP 2002116750 A 4/2002
JP 2008040305 A 2/2008
JP 2008141723 A 6/2008

*Primary Examiner* — Jitesh Patel
(74) *Attorney, Agent, or Firm* — Patterson + Sheridan, LLP

(57) ABSTRACT

Provided is a color adjustment method for a display apparatus. The color adjustment method includes: measuring first luminance coordinate data indicating a luminance and color coordinates of a color displayed on a display device when image data corresponding to a white point is supplied to a drive circuitry; measuring second luminance coordinate data indicating luminances and color coordinates of colors displayed on the display device when image data corresponding to the white color of intermediate grayscale values are supplied to the drive circuitry; measuring third luminance coordinate data indicating a luminance and color coordinates of a color displayed on the display device for each of R, G and B elementary color points when image data corresponding to each of the R, G and B elementary color points is supplied to the drive circuitry; and calculating correction parameters based on the first to third luminance coordinate data.

20 Claims, 12 Drawing Sheets

(56) References Cited

U.S. PATENT DOCUMENTS

| | | | | |
|---|---|---|---|---|
| 2008/0186322 | A1* | 8/2008 | Polak | G09G 5/02 345/589 |
| 2008/0252653 | A1* | 10/2008 | Alessi | G09G 3/3208 345/589 |
| 2009/0002285 | A1* | 1/2009 | Baba | G09G 3/3406 345/77 |
| 2009/0052774 | A1* | 2/2009 | Yoshii | G06T 5/009 382/167 |
| 2010/0259686 | A1* | 10/2010 | Kao | H04N 9/73 348/658 |
| 2011/0032275 | A1* | 2/2011 | Marcu | G09G 3/2003 345/690 |
| 2011/0148910 | A1* | 6/2011 | Botzas | G09G 5/02 345/600 |
| 2011/0149166 | A1* | 6/2011 | Botzas | H04N 5/202 348/649 |
| 2011/0234644 | A1* | 9/2011 | Park | G09G 3/2003 345/690 |
| 2015/0170583 | A1* | 6/2015 | Chen | G09G 3/003 345/690 |
| 2015/0348505 | A1* | 12/2015 | Pyo | G09G 5/10 345/589 |
| 2016/0180782 | A1* | 6/2016 | Nakaya | G09G 3/3648 345/690 |

* cited by examiner

Fig. 6

| | INPUT | OUTPUT |
|---|---|---|
| WHITE POINT | {255, 255, 255} | $\{W_R, W_G, W_B\}$ |
| R ELEMENTARY COLOR POINT | {255, 0, 0} | $\{R_R, R_G, R_B\}$ |
| G ELEMENTARY COLOR POINT | {0, 255, 0} | $\{G_R, G_G, G_B\}$ |
| B ELEMENTARY COLOR POINT | {0, 0, 255} | $\{B_R, B_G, B_B\}$ |
| C COMPLEMENTARY COLOR POINT | {0, 255, 255} | $\{C_R, C_G, C_B\}$ |
| M COMPLEMENTARY COLOR POINT | {255, 0, 255} | $\{M_R, M_G, M_B\}$ |
| Y COMPLEMENTARY COLOR POINT | {255, 255, 0} | $\{Y_R, Y_G, Y_B\}$ |

METHOD AND DEVICE FOR DISPLAY COLOR ADJUSTMENT

CROSS REFERENCE

This application claims priority to Japanese Patent Application No. 2016-096978, filed on May 13, 2016, the disclosure of which is incorporated herein by reference in its entirety.

TECHNICAL FIELD

The present disclosure relates to a color adjustment method, color adjustment apparatus, display driver and display system, more particularly, to a method and device for display color adjustment of a display apparatus.

BACKGROUND ART

Display apparatuses have often to be adapted to display color adjustment. A typical display color adjustment includes adjustments of the color gamut and the white point. As known in the art, sRGB, AdobeRGB, NTSC (National Television System Committee) are typical display device specifications and these specifications individually specify the color gamut and the chromaticity coordinates of the white point. The color gamut is specified as the chromaticity coordinates of the respective elementary colors (R, G and B). The chromaticity coordinates of the elementary color points and white point of a display apparatus is preferably adjusted as specified by the specifications supported by the display apparatus.

One known approach to achieve color adjustment is to perform digital processing on image data of the image to be displayed. For example, Japanese Patent Application Publication No. P2008-40305A discloses a color adjustment technique which involves serially performing: a gamma conversion, an RGB-XYZ conversion, an XYZ-LMS conversion, a color shade adjustment, an LMS-XYZ conversion and an inverse gamma conversion.

Japanese Patent Application Publication No. P2008-141723A discloses a technique for converting YCbCr data into Adobe RGB data through an YCbCr-RGB conversion and an RGB-RGB conversion. This patent document discloses the RGB-RGB conversion involves a gamma conversion, a matric operation and an inverse gamma conversion.

Japanese Patent Application Publication No. P2002-116750A discloses a technique for achieving a precise color correction with a simple circuit configuration. In the technique disclosed in this patent document, the color correction is achieved by serially performing a gamma conversion with an LUT (lookup table), a matrix operation and an inverse gamma conversion with an LUT.

International Publication No. WO2004/070699A discloses a technique which involves: dividing the color gamut of a display device into a plurality of regions with segments which connect the chromaticity coordinate points corresponding to the white color to those corresponding to the elementary color points and the complementary color points; determining which of the regions the chromaticity coordinate point corresponding to the input signal is positioned in; and correcting the RGB values of the input signal on the basis of suitable RGB correction values corresponding to the chromaticity coordinate points corresponding to the three vertices of the region in which the chromaticity coordinate point corresponding to the input signal is positioned. This patent document also refers to calculation of the RGB correction values for the case when the display panel has gamma property proportional to the $2.2^{th}$ power.

However, there is room for improving the preciseness of color adjustment in the above-described techniques.

SUMMARY

Therefore, one objective of the present disclosure is to provide a technique for improving the preciseness of color adjustment.

Other objectives and new features of the present disclosure would be understood by a person skilled in the art from the following disclosure.

Provided in one embodiment is a color adjustment method for a display apparatus including a display device, a color correction circuit performing digital processing on image data for color adjustment and a drive circuitry configured to drive the display device in response to color-adjusted image data received from the color correction circuit. The color adjustment method includes: measuring first luminance coordinate data indicating a luminance and color coordinates of a color displayed on the display device when image data corresponding to a white point is supplied to the drive circuitry; measuring second luminance coordinate data indicating a luminance and color coordinates of a color displayed on the display device when image data corresponding to a white color of at least one intermediate grayscale value is supplied to the drive circuitry; measuring third luminance coordinate data indicating a luminance and color coordinates of a color displayed on the display device for each of R, G and B elementary color points when image data corresponding to each of the R, G and B elementary color points is supplied to the drive circuitry; and calculating correction parameters to be set to the color correction circuit, based on the first to third luminance coordinate data.

Provided in another embodiment is a color adjustment apparatus for performing color adjustment of a display apparatus including: a display device; a color correction circuit performing digital processing on image data for color adjustment; and a drive circuitry configured to drive the display device in response to color-adjusted image data received from the color correction circuit. The color adjustment apparatus includes: a luminance meter measuring first luminance coordinate data indicating a luminance and color coordinates of a color displayed on the display device when image data corresponding to a white point is supplied to the drive circuitry, second luminance coordinate data indicating a luminance and color coordinates of a color displayed on the display device when image data corresponding to a white color of at least one intermediate grayscale value is supplied to the drive circuitry and third luminance coordinate data indicating a luminance and color coordinates of a color displayed on the display device for each of R, G and B elementary color points when image data corresponding to each of the R, G and B elementary color points is supplied to the drive circuitry; and a processing unit configured to calculate correction parameters to be set to the color correction circuit, based on the first to third luminance coordinate data.

In still another embodiment, a display driver includes: a color correction circuit configured to perform digital processing for color adjustment on externally-supplied input image data or data obtained by performing desired digital processing on the input image data; a drive circuitry configured to drive the display device in response to color-adjusted image data received from the color correction circuit; and a nonvolatile memory storing first luminance coordinate data indicating a luminance and color coordinates of a color displayed on the display device when image data corresponding to a white point is supplied to the drive circuitry; second luminance coordinate data indicating a luminance and color coordinates of a color displayed on the display device when image data corresponding to a white color of at least one intermediate grayscale value is supplied to the drive circuitry; and third luminance coordinate data indicating a luminance and color coordinates of a color displayed on the display device for each of R, G and B elementary color points when image data corresponding to each of the R, G and B elementary color points is supplied to the drive circuitry.

In still another embodiment, a display system includes a host, a display device and a display driver driving the display device. The display driver includes: a color correction circuit configured to perform digital processing for color adjustment on input image data supplied from the host or data obtained by performing desired digital processing on the input image data; a drive circuitry configured to drive the display device in response to color-adjusted image data received from the color correction circuit; and a nonvolatile memory storing first luminance coordinate data indicating a luminance and color coordinates of a color displayed on the display device when image data corresponding to a white point is supplied to the drive circuitry; second luminance coordinate data indicating a luminance and color coordinates of a color displayed on the display device when image data corresponding to a white color of at least one intermediate grayscale value is supplied to the drive circuitry; and third luminance coordinate data indicating a luminance and color coordinates of a color displayed on the display device for each of R, G and B elementary color points when image data corresponding to each of the R, G and B elementary color points is supplied to the drive circuitry. The host is configured to receive the first to third luminance coordinate data from the display driver, calculate correction parameters to be set to the color correction circuit based on the first to third luminance coordinate data, and transfer the correction parameters to the display driver.

The present disclosure provides a technique for improving the preciseness of color adjustment.

BRIEF DESCRIPTION OF THE DRAWINGS

FIG. 6 is a table illustrating the input-output property to be set to a color correction circuit with correction parameters;

DETAIL DESCRIPTION OF PREFERRED EMBODIMENTS

Figure 1:
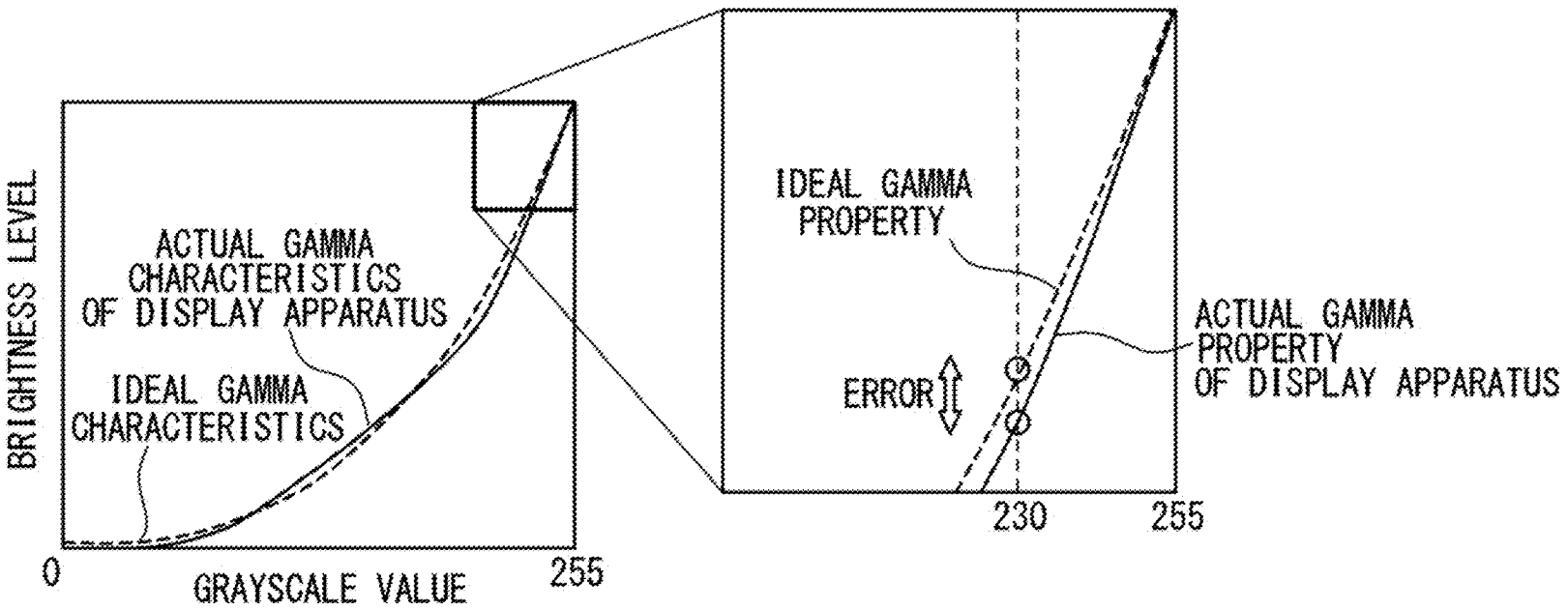
FIG. 1 schematically illustrates an exemplary relation between ideal and actual gamma properties of a display apparatus.

Various embodiments of the present disclosure will be described with reference to the attached drawings. For easiness of understanding, a description is first given of an issue with respect to color adjustment.

The input-output property of a display apparatus is usually non-linear, and such non-linear property is often referred to as gamma property. As is well known in the art, the gamma property of a display apparatus is represented by a gamma value γ in general. For a given gamma value γ, the output y of a display apparatus for an input x can be generally represented as the following function:

$$Y=K\cdot x^{\gamma}, \tag{1}$$

where K is a proportionality constant.

In general, a display apparatus has the function of adjusting the gamma property, more specifically, adjusting the gamma value γ. Most typically, the gamma value γ of a display apparatus is adjusted to 2.2.

It is generally preferable that color adjustment is performed on the ground of the gamma property of the display apparatus. Indeed, the above-cited Japanese Patent Application Publications Nos. P2008-40305A, P2008-141723A and P2002-116750A disclose color adjustment on the ground of the gamma property. International Publication No. WO2004/070699A also refers to the necessity of considering the gamma property of a display apparatus in color adjustment.

One issue with respect to color adjustment is that the actual gamma property of a display apparatus may differ from the ideal gamma property, where the ideal gamma property referred herein is such a property that the input-output property is represented by expression (1) with the gamma value γ specified by the specifications of the display apparatus. The actual property of a display apparatus inevitably differs from the ideal gamma property even after adjustment of the display apparatus with the achievable preciseness. This difference may cause an undesired influence on color adjustment of the display apparatus.

In the following, a discussion is given of influence of the difference between the actual and ideal gamma properties of a display apparatus on color adjustment. In the following description, when the grayscale values of the red, green and blue colors indicated by an image data are "R", "G" and "B", respectively, the image data may be referred to as {R, G, B}. When the image data is generated to represent each of the grayscale values of the red, green and blue colors with eight bits, the allowed maximum grayscale value is 255 and the image data corresponding to the white point (that is, the image data corresponding to the white color of the maximum grayscale values) is {255, 255, 255}.

Discussed below is the case when digital processing for color adjustment is implemented in a display apparatus with an assumption that the gamma value γ of the display apparatus is expected to be 2.2, and the digital processing achieves a correction of an image data of {255, 255, 255}, which corresponds to the white point, to an image data of {255, 255, 230}. In this case, when the actual output of the display apparatus for the grayscale value of 230 determined in accordance with the actual gamma property of the display apparatus is smaller than that expected to be obtained in accordance with the ideal gamma property, the actual brightness level of the blue color is reduced below the desired brightness level in operating the display apparatus in response to the corrected image data obtained by the digital processing. This implies that the digital processing does not achieve desired color adjustment. The above-cited patent documents do not refer to the fact that the actual gamma property of a display apparatus may differ from the ideal gamma property.

The following embodiments are techniques for addressing this problem. In the following, a technique is disclosed which allows improving the preciseness of color adjustment even when the actual gamma property of a display apparatus may differ from the ideal gamma property.

Figure 2:
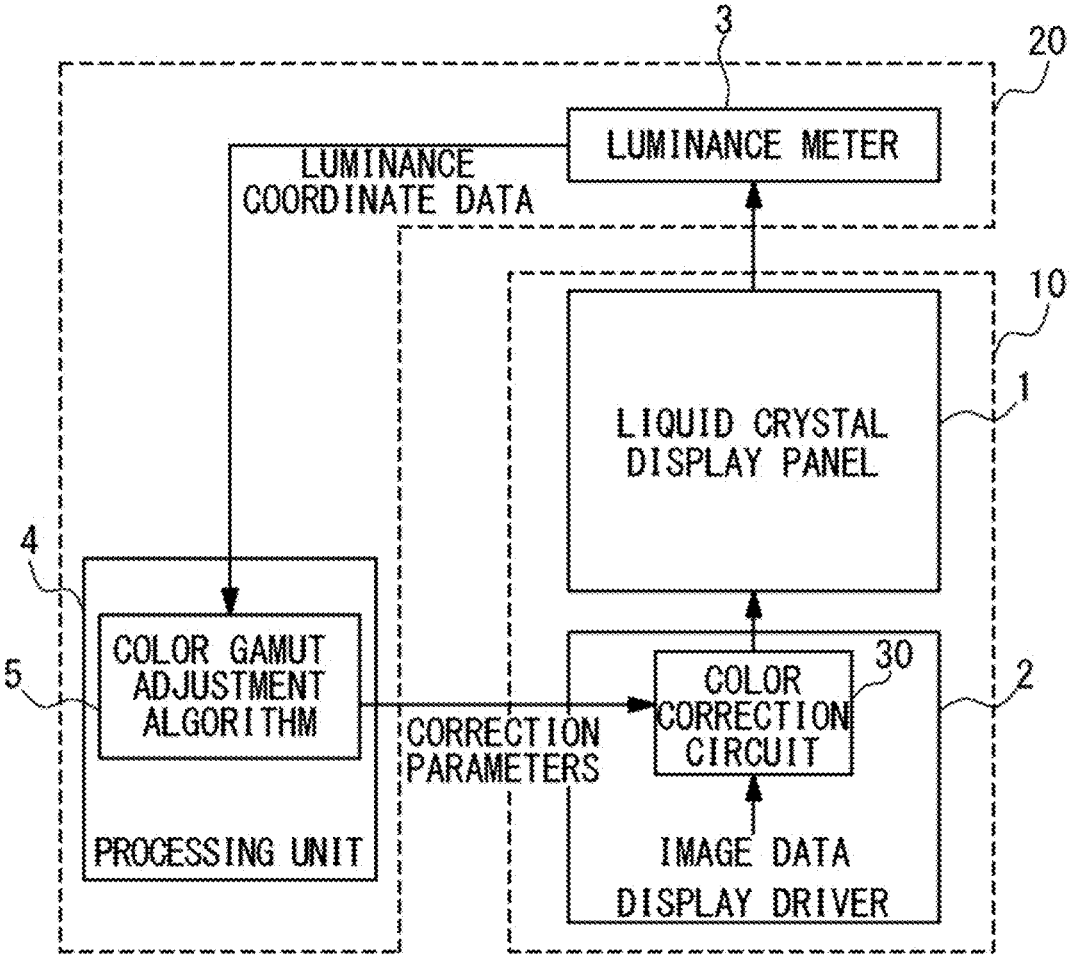
FIG. 2 is a block diagram schematically illustrating exemplary configurations of a display apparatus and a color adjustment apparatus in one embodiment.

FIG. 2 is a block diagram schematically illustrating exemplary configurations of a display apparatus, for which display color adjustment is performed, and a color adjustment apparatus used for the display color adjustment of the display apparatus, in one embodiment.

In the present embodiment, a display apparatus 10 is configured as a liquid crystal display apparatus including a liquid crystal display panel 1 and a display driver 2. Although a description is given below of embodiments in which the display apparatus 10 is configured as a liquid crystal display apparatus, a person skilled in the art would appreciate that the present disclosure is applicable to display apparatuses which include a display device other than the liquid crystal display panel 1 (e.g., an OLED (organic light emitting diode) display panel).

The liquid crystal display panel 1 includes pixels arrayed in rows and columns, gate lines and source lines (these elements are not illustrated). In the present embodiment, each pixel includes an R subpixel displaying the red color, a G subpixel displaying the green color, and a B subpixel displaying the blue color. Each subpixel (the R, G or B subpixel) is connected to the corresponding gate line and source line.

The display driver 2 drives the source lines of the liquid crystal display panel 1 in response to image data. The display driver 2 is adapted to color adjustment; the display driver 2 includes a color correction circuit 30 which performs digital processing on image data for color adjustment. The display driver 2 drives the source lines of the liquid crystal display panel 1 in response to image data output from the color correction circuit 30 (hereinafter, referred to as "color-adjusted image data.")

The color adjustment of the display apparatus 10 is achieved by properly setting the color correction circuit 30. More specifically, correction parameters to achieve desired color adjustment are supplied to the display driver 2 and the color correction circuit 30 performs the digital processing in response to the correction parameters to achieve color adjustment, including adjustment of the color gamut and white point of the display apparatus 10.

The color adjustment apparatus 20 calculates the correction parameters to be set to the color correction circuit 30 and supplies the calculated correction parameters to the display driver 2. The correction parameters are written into a non-volatile memory of the display driver 2, for example, and the color correction circuit 30 preforms digital processing on image data in response to the correction parameters stored in the non-volatile memory.

In the present embodiment, the color adjustment apparatus 20 includes a luminance meter 3 and a processing unit 4.

The luminance meter 3 is configured to obtain a luminance coordinate data of the color displayed on the liquid crystal display panel 1 of the display apparatus 10. As described in detail later, when a luminance coordinate data of a specific color is obtained, the specific color is displayed on the liquid crystal display panel 1 in full-screen and the luminance meter 3 measures the stimulus value Y and chromaticity coordinates (x, y) of the color displayed on the liquid crystal display panel 1. In the present embodiment, the stimulus value Y and chromaticity coordinates (x, y) are defined in accordance with the Yxy color system. The stimulus value Y represents the luminance and, to clarify this, the stimulus value Y may be also referred to as "luminance Y" in the following. The luminance coordinate data include data indicating the luminance Y and chromaticity coordinates (x, y). The luminance meter 3 generates a luminance coordinate data which indicates the measured luminance Y and chromaticity coordinates (x, y).

The processing unit 4 calculates correction parameters to be set to the color correction circuit 30 on the basis of the luminance coordinate data received from the luminance meter 3. In the present embodiment, a software program to perform a color gamut adjustment algorithm 5 is installed on the processing unit 4 and the measurement of the luminance coordinate data by the luminance meter 3 and the calculation of the correction parameters are achieved by executing the color gamut adjustment algorithm 5 by the processing unit 4. The calculation procedure of the correction parameters will be described later in detail.

Figure 3:
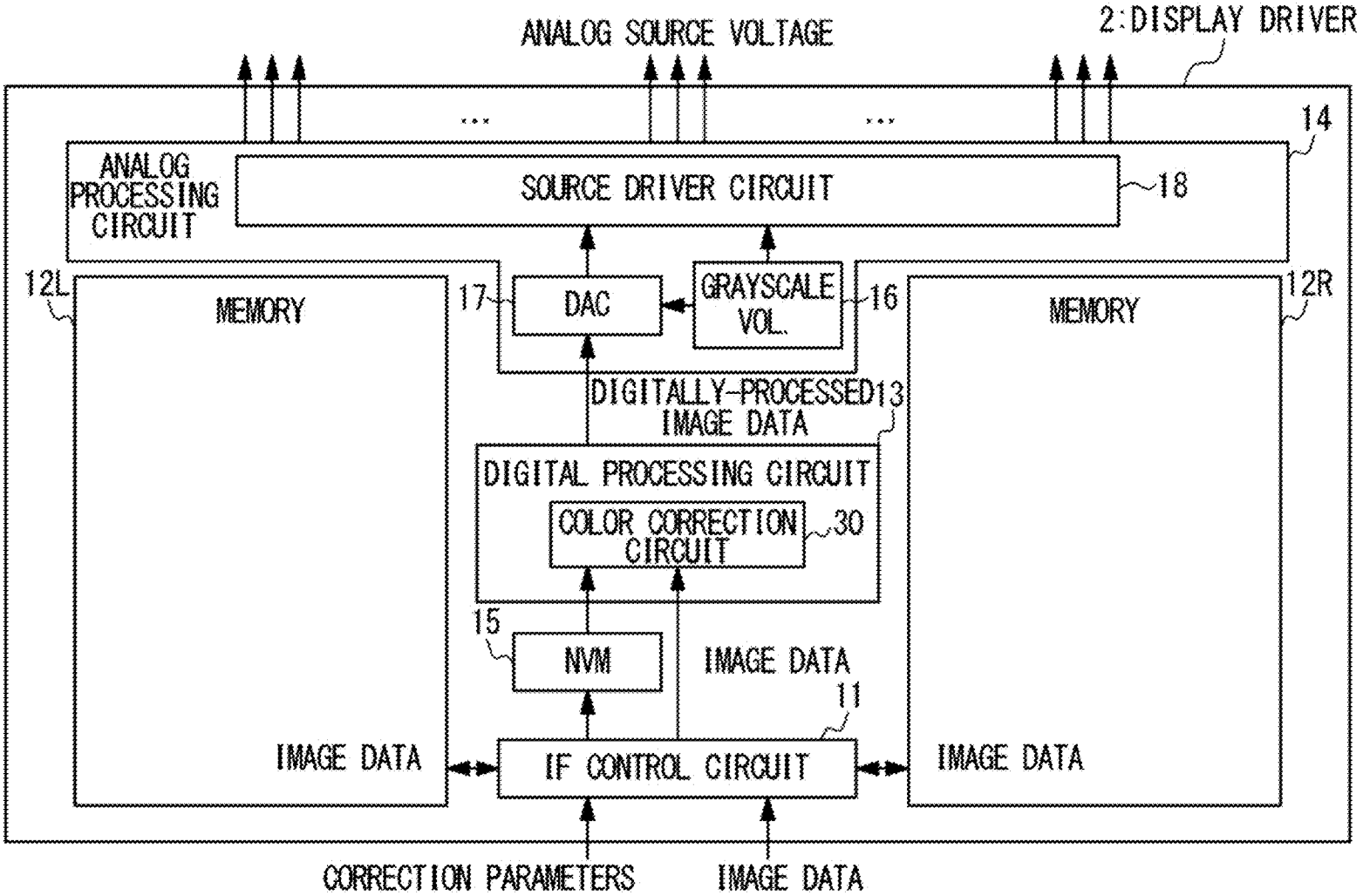
FIG. 3 is a block diagram schematically illustrating an exemplary configuration of a display driver in one embodiment.

FIG. 3 is a block diagram illustrating an exemplary configuration of a display driver 2 in one embodiment. In the present embodiment, the display driver 2 includes an interface control circuit 11, memories 12R and 12L, a digital processing circuit 13, an analog processing circuit 14, a non-volatile memory (NVM) 15.

The interface control circuit 11 receives externally-supplied data (from a host, for example). In detail, the interface control circuit 11 externally receives image data (from a host, for example), writes the received image data into the memories 12L and 12R and transfers the image data stored in the memories 12L and 12R to the digital processing circuit 13. The interface control circuit 11 also receives the correction parameters from the color adjustment apparatus 20 and writes the correction parameters into the non-volatile memory 15.

The memories 12L and 12R temporarily stores the image data received from the interface control circuit 11.

The digital processing circuit 12 performs desired digital processing on the image data received from the memories 12L and 12R via the interface control circuit 11 to generate digitally-processed image data. The digital processing circuit 13 includes the above-described color correction circuit 30. The color correction circuit 30 performs, in response to the correction parameters stored in the non-volatile memory 15, digital processing for color adjustment on the image data received from the memories 12L and 12R or data obtained by performing desired digital processing on the image data, to generate color-adjusted image data. The color-adjusted image data output from the color correction circuit 30 or data obtained through performing desired digital processing on the color-adjusted image data are output from the digital processing circuit 13 as the above-described digitally-processed image data.

The analog processing circuit 14 operates as a drive circuitry which drives the source lines of the liquid crystal display panel 1 in response to the digitally-processed image data received from the digital processing circuit 13 (that is, in response to the color-adjusted image data output from the color correction circuit 30.) More specifically, the analog processing circuit 14 includes a grayscale voltage generator circuit 16, a DA converter (DAC) 17 and a source driver circuit 18.

The grayscale voltage generator circuit 16 generates a set of grayscale voltages having voltage levels which match the targeted gamma property of the display apparatus 10 and supplies the set of grayscale voltages to the DA converter 17. The gamma property of the display apparatus 10 can be adjusted by controlling the voltage levels of the grayscale voltages generated by the grayscale voltage generator circuit 16.

The DA converter 17 selects grayscale voltages corresponding to the digitally-processed image data for the respective source lines of the liquid crystal display panel 1 and outputs the selected grayscale voltages.

The source driver circuit 18 outputs analog source voltages having voltage levels corresponding to the grayscale voltages received from the DA converter 17 (most typically, the voltage levels equal to those of the grayscale voltages) to the respective source lines of the liquid crystal display panel 1 to thereby drive the source lines.

The non-volatile memory 15 stores various control parameters used for controlling the operation of the display driver 2 in a non-volatile manner. The control parameters stored in the non-volatile memory 15 include the correction parameters to be supplied to the color correction circuit 30. As described above, in the color adjustment of the display apparatus 10, the correction parameters to be supplied to the color correction circuit 30 are first calculated by the color adjustment apparatus 20. The calculated correction parameters are written into the non-volatile memory 15 via the interface control circuit 11. When the display driver 2 operates to display an image on the liquid crystal display panel 1, the correction parameters read out from the non-volatile memory 15 are supplied to the color correction circuit 30 and digital processing is performed by the color correction circuit 30 in response to the correction parameters.

Figure 4:
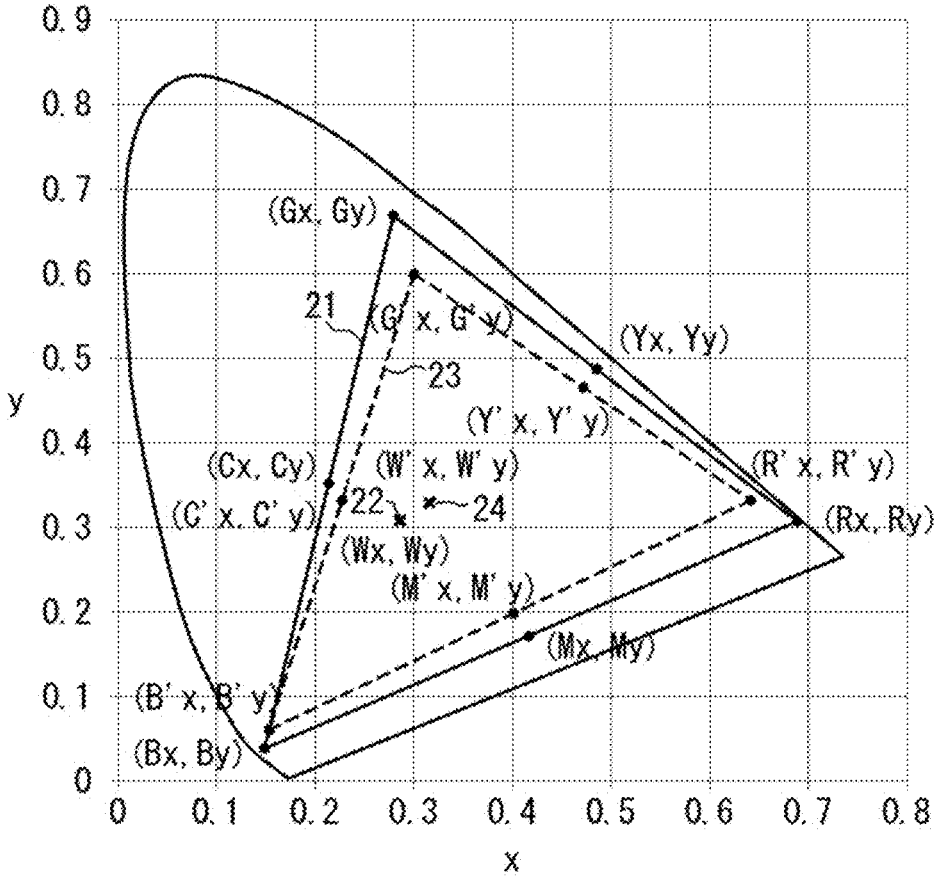
FIG. 4 illustrates adjustments of the color gamut and the white point in the color adjustment in the present embodiment.

Next, a description is given of color adjustment performed in the present embodiment. In the color adjustment of the present embodiment, the color gamut and the white point are adjusted. FIG. 4 is a chromaticity diagram illustrating the adjustment of the color gamut and the white point in the present embodiment. In FIG. 4, the horizontal axis corresponds to the chromaticity coordinate x and the vertical axis corresponds to the chromaticity coordinate y.

In FIG. 4, the triangle indicated by the numeral 21 represents the color gamut of the liquid crystal display panel 1. (Rx, Ry) represents the chromaticity coordinates of the R elementary color point of the color gamut 21 of the liquid crystal display panel 1. Similarly, (Gx, Gy) and (Bx, By) represent the chromaticity coordinates of the G and B elementary color points of the color gamut 21, respectively. Furthermore, (Cx, Cy) represents the chromaticity coordinates of the C complementary color point of the color gamut 21 of the liquid crystal display panel 1. Similarly, (Mx, My) and (Yx, Yy) represent the chromaticity coordinates of the M and Y complementary color points of the color gamut 21, respectively. The numeral 22 indicates the white point of the liquid crystal display panel 1 and (Wx, Wy) represents the chromaticity coordinates of the white point.

Strictly speaking, the chromaticity coordinates of the R elementary color point of the color gamut 21 of the liquid crystal display panel 1 should be understood as the chromaticity coordinates of the color displayed on the liquid crystal display panel 1 when the image data supplied to the analog processing circuit 14 indicates that the grayscale value of the elementary color R is the allowed maximum value and the grayscale values of the elementary colors G and B are the allowed minimum value. The similar goes for the other elementary color points (the G and B elementary color points.) Similarly, the chromaticity coordinates of the C complementary color point of the color gamut 21 of the liquid crystal display panel 1 should be understood as the chromaticity coordinates of the color displayed on the liquid crystal display panel 1 when the image data supplied to the analog processing circuit 14 indicates that the grayscale value of the elementary color R is the allowed minimum value and the grayscale values of the elementary colors G and B are the allowed maximum value. The similar goes for the other complementary color points (the M and Y complementary color points.) Furthermore, the chromaticity coordinates of the white point of the liquid crystal display panel 1 should be understood as the chromaticity coordinates of the color displayed on the liquid crystal display panel 1 when the image data supplied to the analog processing circuit 14 indicates that the grayscale values of the elementary colors R, G and B are all the allowed maximum value.

The objective of the color adjustment of the present embodiment is to calculate the correction parameters to be set to the color correction circuit 30 so as to achieve the color gamut and white point defined in the sRGB specification in displaying images on the liquid crystal display panel 1. In FIG. 4, the numeral 23 denotes the color gamut defined in the sRGB specification and the numeral 24 denotes the white point. (Rx', Ry') represents the chromaticity coordinates of the R elementary color point of the color gamut 23 defined in the sRGB specification and (Gx', Gy') and (Bx', By') represent the chromaticity coordinates of the G and B elementary color points of the color gamut 23 defined in the sRGB specification, respectively. Furthermore, (Cx', Cy') represents the chromaticity coordinates of the C complementary color point of the color gamut 23 defined in the sRGB specification and (Mx', My') and (Yx', Yy') represent the chromaticity coordinates of the M and Y complementary color points of the color gamut 23 defined in the sRGB specification, respectively. Finally, (Wx', Wy') represents the chromaticity coordinates of the white point of the color gamut 23 defined in the sRGB specification.

The correction parameters to be set to the color correction circuit 30 are calculated so that, when an image data corresponding to the R elementary color point (that is, an image data indicating that the R grayscale value is the allowed maximum value, and the G and B grayscale values are the allowed minimum value) is supplied to the color correction circuit 30, the color of the chromaticity coordinates (Rx', Ry') specified for the R elementary color point in the sRGB specification is displayed on the liquid crystal display panel 1 in driving the liquid crystal display panel 1 in response to the image data output from the color correction circuit 30 (which may be referred to as "color-adjusted image data", hereinafter.) The similar goes for the G elementary color point, the B elementary color point, the C complementary color point, the M complementary color point, the Y complementary color point and the white point.

As discussed above, it is preferable that color adjustment is achieved on the ground of the gamma property of the display apparatus 10. In the present embodiment, color adjustment of a higher preciseness is achieved on the basis of the actual gamma property of the display apparatus 10 (in place of the ideal gamma property defined by the specifications.) In the following, a description is specifically given of the procedure of color adjustment on the basis of the actual gamma property of the display apparatus 10 in the present embodiment.

Figure 5:
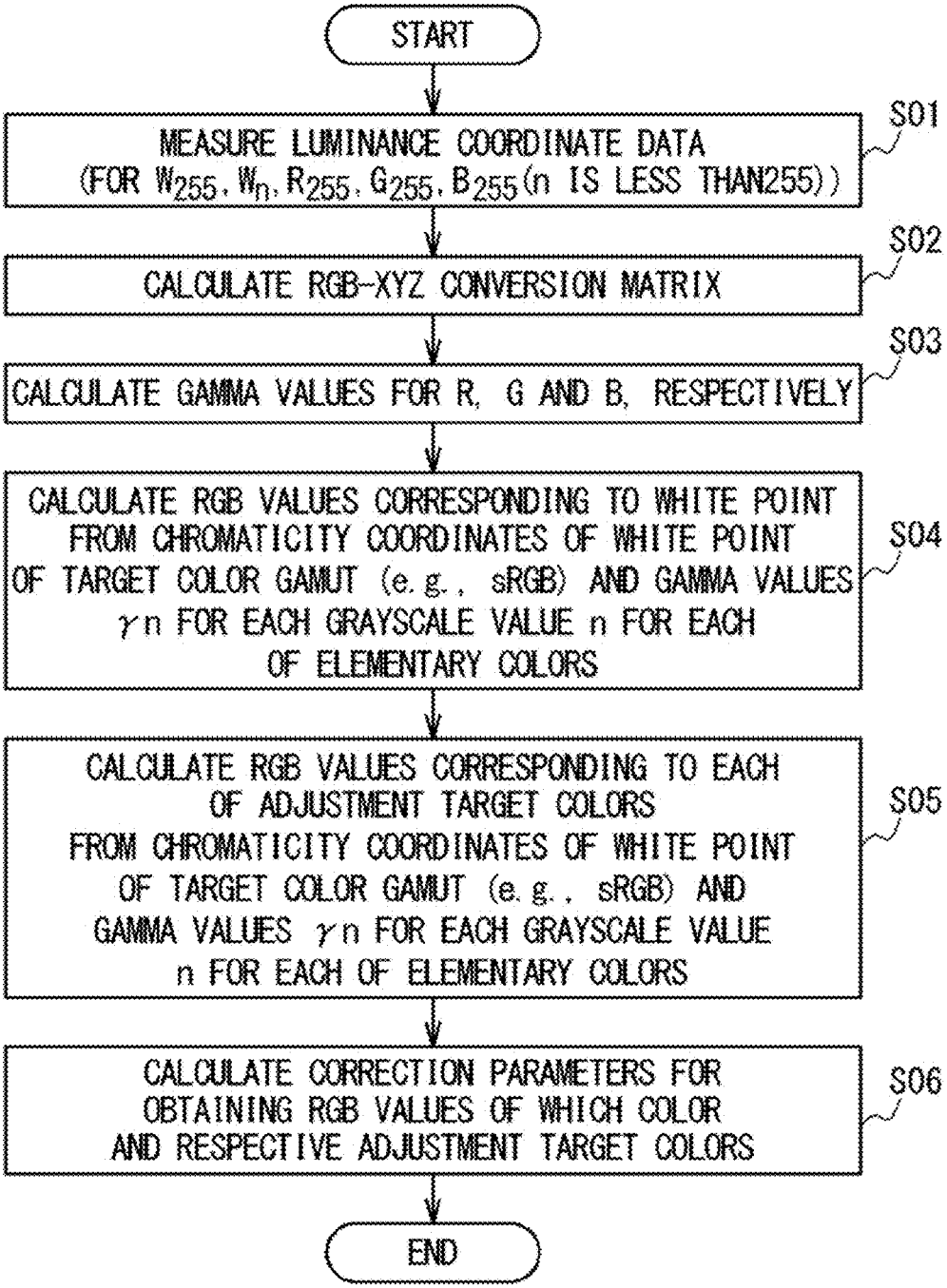
FIG. 5 is a flowchart illustrating the procedure of color adjustment in the present embodiment.

FIG. 5 is a flowchart illustrating the procedure of color adjustment, that is, the procedure of calculation of the correction parameters to be set to the color correction circuit 30, in the present embodiment. It should be noted that, when the color adjustment apparatus illustrated in FIG. 1 is used, the correction parameters to be set to the color correction circuit 30 are calculated by executing the color gamut adjustment algorithm 5 by the processing unit 4.

(Step S01)

The color adjustment of the display apparatus 10 of the present embodiment starts with measurement of luminance coordinate data of the display apparatus 10. The luminance coordinate data are measured in the state in which the digital processing for color adjustment is not performed by the color correction circuit 30.

At step S01, luminance coordinate data of the R, G and B elementary color points and the white point (that is, the luminance coordinate data of the R, G and B elementary colors and the white color of the allowed maximum grayscale values) and a luminance coordinate data of the white color of at least one intermediate grayscale value are measured. Strictly speaking, the luminance coordinate data corresponding to the R elementary color point is a data indicating the luminance Y and chromaticity coordinates (x, y) of the color displayed on the liquid crystal display panel 1, when an image data which indicates that the grayscale value of the elementary color R is the allowed maximum value and those of the elementary colors G and B are the allowed minimum value is supplied to the analog processing circuit 14; the luminance coordinate data corresponding to the R elementary color point is measured by the luminance meter 3 of the color adjustment apparatus 20. The luminance Y and the chromaticity coordinates (x, y) are defined in accordance with the Yxy color system. The similar goes for the luminance coordinate data of the G and B elementary color points. Also, the luminance coordinate data corresponding to the white point (the white color of the allowed maximum grayscale value) is a data indicating the luminance Y and chromaticity coordinates (x, y) of the color displayed on the liquid crystal display panel 1, when an image data which indicates that the grayscale values of the elementary colors R, G and B are all the allowed maximum value is supplied to the analog processing circuit 14. Finally, the luminance coordinate data corresponding to the white color of an intermediate grayscale value is a data indicating the luminance Y and chromaticity coordinates (x, y) of the color displayed on the liquid crystal display panel 1, when an image data which indicates that the grayscale values of the elementary colors R, G and B, which are equal to one another, are all equal to an intermediate grayscale value (smaller than the allowed maximum value and larger than the allowed minimum value) is supplied to the analog processing circuit 14.

When image data are defined so that the grayscale values of the elementary colors R, G and B are each represented with eight bits, the allowed maximum grayscale value is "255" and the allowed minimum grayscale value is "0". In the following, embodiments are described with an assumption that image data are defined so that the grayscale values of the elementary colors R, G and B are each represented with eight bits, that is, the allowed maximum grayscale value is "255" and the allowed minimum grayscale value is "0".

It should be noted that, as described in detail in the following, the luminance coordinate data corresponding to the white color of an intermediate grayscale value is used to calculate the correction parameters to be set to the color correction circuit 30 in the present embodiment. This aims at achieving color adjustment on the ground of the actual gamma property of the display apparatus 10. The luminance coordinate data corresponding to the white color of an intermediate grayscale value includes information of the actual gamma property of the display apparatus 10. Accordingly, it is possible to achieve color adjustment on the ground of the actual gamma property of the display apparatus 10 by generating the correction parameters to be set to the color correction circuit 30 in response to the luminance coordinate data corresponding to the white color of an intermediate grayscale value.

When luminance coordinate data are measured, image data externally supplied to the display driver 2 may be supplied to the analog processing circuit 14 without change while the operation of the digital processing circuit 13 is stopped. In this case, image data listed below are externally supplied to the display driver 2 and transferred to the analog processing circuit 14:

(a) an image data which indicates that, for all the pixels, the grayscale value of the elementary color R is the allowed maximum value (that is, "255") and the grayscale values of the other elementary colors G and B are the allowed minimum value (that is, "0");

(b) an image data which indicates that, for all the pixels, the grayscale value of the elementary color G is the allowed maximum value and the grayscale values of the other elementary colors B and R are the allowed minimum value;

(c) an image data which indicates that, for all the pixels, the grayscale value of the elementary color B is the allowed maximum value and the grayscale values of the other elementary colors R and G are the allowed minimum value;

(d) an image data which indicates that, for all the pixels, the grayscale values of the elementary colors R, G and B are all the allowed maximum value; and (e) image data which indicate that, for all the pixels, the grayscale values of the elementary colors R, G and B are all equal to an intermediate grayscale value. The analog processing circuit 14 drives the source lines of the liquid crystal display panel 1 in response to the image data supplied thereto.

In an alternative embodiment, the digital processing circuit 13 may be configured to generate the above-described image data used to obtain the luminance coordinate data of the display apparatus 10. In this case, the digital processing circuit 13 generates the above-described image data (a) to (e) in response to a command externally supplied to the display driver 2 and supplies the same to the analog processing circuit 14.

(Step S02)

This is followed by calculating an XYZ-RGB conversion matrix from the luminance coordinate data corresponding to the R, G and B elementary color points and the white point.

The calculation of the XYZ-RGB conversion matrix involves first calculating an RGB-XYZ conversion matrix from the luminance coordinate data corresponding to the R, G and B elementary color points and the white point and then calculating the XYZ-RGB conversion matrix as the inverse matrix of the RGB-XYZ conversion matrix.

More specifically, when the luminance Y and the chromaticity coordinates of the R, G, and B elementary colors and the white point are indicated as ($R_Y$, Rx, Ry), ($G_Y$, Gx, Gy), ($B_Y$, Bx, By) and ($W_Y$, Wx, Wy), respectively, in the luminance coordinate data obtained by the measurement at step S01, the RGB-XYZ conversion matrix is calculated as the following matrix M:

$$M = \begin{pmatrix} rRx/Ry & gGx/Gy & bBx/By \\ r & g & b \\ rRz/Ry & gGz/Gy & bBz/By \end{pmatrix}, \tag{1a}$$

where Rz, Gz, Bz and Wz are z coordinates of the R, G and B elementary color points and the white point in the xyz color system, respectively. The above-described expression (1a) is derived on the basis of the fact that the following holds in the xyz color system:

$$z=1-x-y.$$

In other words, the following holds:

$$Rz=1-Rx-Ry,$$

$$Gz=1-Gx-Gy,$$

$$Bz=1-Bx-By, \text{ and}$$

$$Wz=1-Wx-Wy.$$

The parameters r, g and b are obtained by solving the following simultaneous equation (1b):

$$\begin{pmatrix} Wx/Wy \\ 1 \\ Wz/Wy \end{pmatrix} = \begin{pmatrix} Rx/Ry & Gx/Gy & Bx/By \\ 1 & 1 & 1 \\ Rz/Ry & Gz/Gy & Bx/By \end{pmatrix} \begin{pmatrix} r \\ g \\ b \end{pmatrix}. \tag{1b}$$

The RGB-XYZ conversion matrix M represents the relationship between RGB values {R, G, B} and color coordinates (X, Y, Z) and the following expression (2a) holds:

$$\begin{pmatrix} X \\ Y \\ Z \end{pmatrix} = M \begin{pmatrix} R \\ G \\ B \end{pmatrix} = \begin{pmatrix} rRx/Ry & gGx/Gy & bBx/By \\ r & g & b \\ rRz/Ry & gGz/Gy & bBz/By \end{pmatrix} \begin{pmatrix} R \\ G \\ B \end{pmatrix}. \tag{2a}$$

It should be especially noted that, for the luminance value Y (stimulus value Y), the following expression (2b) holds:

$$Y=rR+gG+bB. \tag{2b}$$

The XYZ-RGB matrix is obtained as the inverse matrix $M^{-1}$ of the above-described matrix M; the XYZ-RGB matrix can be represented by the following expression (3):

$$\begin{pmatrix} X \\ Y \\ Z \end{pmatrix} = M \begin{pmatrix} R \\ G \\ B \end{pmatrix} = \begin{pmatrix} rRx/Ry & gGx/Gy & bBx/By \\ r & g & b \\ rRz/Ry & gGz/Gy & bBz/By \end{pmatrix} \begin{pmatrix} R \\ G \\ B \end{pmatrix}. \tag{2a}$$

(Step S03)

This is followed by calculating a gamma value of each grayscale value for each of the white color and the elementary colors R, G and B. The gamma value of a certain grayscale value means a gamma value locally defined for the grayscale value. When the display apparatus 10 is ideally adjusted, the gamma value is kept to a constant value (e.g., 2.2) regardless of the grayscale value; however, as descried above, the actual gamma property of the display apparatus 10 may depart from the gamma property expressed by a specific gamma value. In the present embodiment, an assumption is introduced in which the display apparatus 10 locally has a gamma property in accordance with expression (1) but the gamma value depends on the grayscale value and the color. On the basis of this assumption, the gamma value of each grayscale value is calculated for each of the white color and the elementary colors R, G and B.

More specifically, the gamma values of the respective grayscale values for the white color are calculated on the basis of the luminance coordinate data of the white point (that is, the luminance coordinate data corresponding to the white color of the allowed maximum grayscale value) and the luminance coordinate data of the white color of at least one intermediate grayscale value. In the following, the gamma value of grayscale value i for the white color is referred to as $\gamma_i$, hereinafter.

It should be noted that the description given below is based on an assumption that luminance coordinate data are obtained for the white color of p intermediate grayscale values n1, n2, . . . , np at step S01, for p being an integer of one or more. The "white color of an intermediate grayscale value nj" referred to herein means the while color with respect to which the R, G and B grayscale values are all specified as being nj, wherein it holds:

$$0<n1<n2< \ldots <np<RGB_{MAX}, \tag{4}$$

where $RGB_{MAX}$ is the allowed maximum grayscale value. In the present embodiment, the R, G and B grayscale values of image data are represented with eight bits and the allowed maximum grayscale value $RGB_{MAX}$ is "255."

Also, the luminance coordinate data of the white point (that is, the white color of the allowed maximum grayscale value) obtained at step S01 may be referred to as "$W_{WP}$" in the following. The luminance coordinate data $W_{WP}$ of the white point is described in the Yxy color system and represented as in the following expression (5a):

$$W_{WP}=(Y_{WP},x_{WP},y_{WP}), \tag{5a}$$

where $Y_{WP}$ is the luminance Y described in the luminance coordinate data $W_{WP}$ of the white point, $x_{WP}$ is the chromaticity coordinate x described in the luminance coordinate data $W_{WP}$, and $y_{WP}$ is the chromaticity coordinate y described in the luminance coordinate data $W_{WP}$.

Similarly, the luminance coordinate data of the white color of a grayscale value nj obtained at step S01 may be referred to as "$W_{nj}$" in the following, for j is an integer from one to p. The luminance coordinate data $W_{WP}$ of the white color of the grayscale value nj is described in the Yxy color system and represented as in the following expression (5b):

$$W_{nj}=(Y_{nj},x_{nj},y_{nj}) \tag{5b}$$

where $Y_{nj}$ is the luminance Y described in the luminance coordinate data $W_{nj}$ of the white color of the grayscale value nj, $x_{nj}$ is the chromaticity coordinate x described in the luminance coordinate data $W_{nj}$, and $y_{nj}$ is the chromaticity coordinate y described in the luminance coordinate data $W_{nj}$.

With respect to the grayscale values n1, n2, . . . , np, for which the luminance coordinate data are measured, the gamma value $\gamma_{nj}$ of the grayscale value nj with respect to the white color is calculated in accordance with the following expression (6) for j being an integer from one to p:

$$\gamma_{nj} = \frac{\log(Y_{nj}/Y_{WP})}{\log(nj/RGB_{MAX})}. \tag{6}$$

For the remaining grayscale values i (the grayscale values other than the intermediate grayscale values n1, n2, . . . , np), the gamma values $\gamma_j$ of the grayscale values i with respect to the white color are calculated from the gamma values $\gamma_{n1}$, $\gamma_{n2}$, . . . , $\gamma_{np}$ of the intermediate grayscale values n1, n2, . . . , np, for which the luminance coordinate data are measured. When the luminance coordinate data are measured for two or more intermediate grayscale values (that is, p is two or more), for example, the gamma values $\gamma_i$ of other grayscale values i are calculated from the gamma values $\gamma_{n1}$, $\gamma_{n2}$, . . . , $\gamma_{np}$ of the intermediate grayscale values n1, n2, . . . , np with interpolation or extrapolation. The interpolation may be achieved with a linear interpolation method, or when the luminance coordinate data are measured for three or more intermediate grayscale values, with a non-linear interpolation method. Similarly, the extrapolation may be achieved with a linear extrapolation method, or when the luminance coordinate data are measured for three or more intermediate grayscale values, with a non-linear interpolation method. When the luminance coordinate data is measured for only one intermediate grayscale value n1 (that is, when p is one), the gamma value $\gamma_i$ of the grayscale values i for which the luminance coordinate data is not measured with respect to the white color may be determined as being equal to the gamma value $\gamma_{n1}$ of the intermediate grayscale value n1, for which the luminance coordinate data are measured.

Additionally, the grayscale values of the respective grayscale values are calculated for each of the elementary colors R, G and B. With respect to the grayscale values n1, n2, . . . , np, for which the luminance coordinate data are measured, the gamma value $R\gamma_{nj}$ of the grayscale value nj with respect to the elementary color R, the gamma value $G\gamma_{nj}$ of the grayscale value nj with respect to the elementary color G and the gamma value $B\gamma_{nj}$ of the grayscale value nj with respect to the elementary color B are calculated in accordance with the following expressions (7a) to (7c):

$$R\gamma_{nj} = \frac{\log(R_{nj}/R_{WP})}{\log(nj/RGB_{MAX})}, \tag{7a}$$

$$G\gamma_{nj} = \frac{\log(G_{nj}/G_{WP})}{\log(nj/RGB_{MAX})}, \text{ and} \tag{7b}$$

-continued $$B\gamma_{nj} = \frac{\log(B_{nj}/B_{WP})}{\log(nj/RGB_{MAX})}. \tag{7c}$$

It should be noted that $R_{WP}$, $G_{WP}$ and $B_{WP}$ in expressions (7a) to (7c) are obtained from the luminance coordinate data $W_{WP}$ (=($Y_{WP}$, $x_{WP}$, $y_{WP}$)) in accordance with the following expressions (8a) to (8c):

$$X_{WP} = Y_{WP} \times x_{WP} \div y_{WP}, \tag{8a}$$

$$Z_{WP} = Y_{WP}(1 - x_{WP} - y_{WP}) \div y_{WP}, \text{ and} \tag{8b}$$

$$\begin{pmatrix} R_{WP} \\ G_{WP} \\ B_{WP} \end{pmatrix} = M^{-1} \begin{pmatrix} X_{WP} \\ Y_{WP} \\ Z_{WP} \end{pmatrix}. \tag{8c}$$

Expressions (8a) and (8c) are used to convert the luminance $Y_{WP}$ and chromaticity coordinates $x_{WP}$ and $y_{WP}$ of the luminance coordinate data $W_{WP}$, which is described in the Yxy color system, into the color coordinates $X_{WP}$, $Y_{WP}$ and $Z_{WP}$ in the XYZ color system, and expression (8c) is used to perform an XYZ-RGB conversion on the color coordinates $X_{WP}$, $Y_{WP}$ and $Z_{WP}$. The inverse matrix $M^{-1}$ is the XYZ-RGB conversion matrix calculated at step S02 in accordance with expression (3).

$R_{nj}$, $G_{nj}$ and $B_{nj}$ in expressions (7a) to (7c) are obtained from the luminance coordinate data $W_{nj}$ (=($Y_{nj}$, $x_{nj}$, $y_{n}$j)) in accordance with the following expressions (8a) to (8c):

$$X_{nj} = Y_{nj} \times x_{nj} \div y_{nj}, \tag{9a}$$

$$Z_{nj} = Y_{nj}(1 - x_{nj} - y_{nj}) \div y_{nj}, \text{ and} \tag{9b}$$

$$\begin{pmatrix} R_{nj} \\ G_{nj} \\ B_{nj} \end{pmatrix} = M^{-1} \begin{pmatrix} X_{nj} \\ Y_{nj} \\ Z_{nj} \end{pmatrix}. \tag{9c}$$

With respect to the grayscale values i for which the luminance grayscale data are not measured, the gamma values $R\gamma_i$ of the grayscale values i with respect to the elementary color R, the gamma values $G\gamma_i$ of the grayscale values i with respect to the elementary color G and the gamma values $B\gamma_i$ of the grayscale value i with respect to the elementary color B are calculated from the gamma values $R\gamma_{nj}$, $G\gamma_{nj}$ and $B\gamma_{nj}$ of the intermediate grayscale values nj, for which the luminance coordinate data are measured, where j is an integer from one to p. More specifically, when the luminance coordinate data are measured for two or more intermediate grayscale values (that is, p is two or more), for example, the gamma values $R\gamma_i$ of other grayscale values i with respect to the elementary color R are calculated from the gamma values $R\gamma_{n1}$, $R\gamma_{n2}$, . . . , $R\gamma_{np}$ of the intermediate grayscale values n1, n2, . . . , np with interpolation or extrapolation. Similarly, the gamma values $G\gamma_i$ of other grayscale values i with respect to the elementary color G are calculated from the gamma values $G\gamma_{n1}$, $G\gamma_{n2}$, . . . , $G\gamma_{np}$ of the intermediate grayscale values n1, n2, . . . , np with interpolation or extrapolation and the gamma values $B\gamma_i$ of other grayscale values i with respect to the elementary color B are calculated from the gamma values $B\gamma_{n1}$, $B\gamma_{n2}$, . . . , $B\gamma_{np}$ of the intermediate grayscale values n1, n2, . . . , np with interpolation or extrapolation. The interpolation may be achieved with a linear interpolation method, or when the luminance coordinate data are measured for three or more intermediate grayscale values, with a non-linear interpolation method. Similarly, the extrapolation may be achieved with a linear extrapolation method, or when the luminance coordinate data are measured for three or more intermediate grayscale values, with a non-linear interpolation method.

When the luminance coordinate data is measured for only one intermediate grayscale value n1 (that is, when p is one), the gamma values $R\gamma_i$, $G\gamma_i$ and $B\gamma_i$ of the grayscale values i for which the luminance coordinate data is not measured may be respectively determined as being equal to the gamma value $R\gamma_{n1}$, $G\gamma_{n1}$ and $B\gamma_{n1}$ of the intermediate grayscale value n1, for which the luminance coordinate data are measured.

(Step S04)

This is followed by calculating the R, G and B grayscale values to display the white point (the white color of the allowed maximum grayscale value) with desired chromaticity coordinates at step S04. In the present embodiment, the R, G and B grayscale values to display a color with desired chromaticity coordinates means such R, G and B grayscale values that the color with the desired chromaticity coordinates is displayed on the liquid crystal display panel, when an image data of the R, G and B grayscale values are input to the analog processing circuit 14 (or when a digitally-processed image data of the R, G and B grayscale values is output from the digital processing circuit 14). In the following, the R, G and B grayscale values to display the white point with the desired chromaticity coordinates are referred to as "desired RGB values of the white point".

In the present embodiment, in which the desired color gamut is defined in accordance with the sRGB specification, the R, G and B grayscale values to display the white color on the liquid crystal display panel 1 with the chromaticity coordinates x and y of the white point specified by the sRGB specification are calculated as the desired RGB values of the white point at step S04. In the following, the chromaticity coordinates of the white point specified by the sRGB specification are referred to as ($W_Y'$, Wx', Wy'). The chromaticity coordinates of the white point are described in the Yxy color system. Accordingly, $W_Y'$ represents the luminance Y (the stimulus value Y) of the white point specified by the sRGB specification, and Wx' and Wy' represent the chromaticity coordinates x and y of the white point, respectively. It should be noted that the luminance Y of the white point is used as the reference of the luminance of a different color, and therefore $W_Y'=1.0000$.

First, the chromaticity coordinates ($W_Y'$, Wx', Wy') of the white point specified by the sRGB specification are converted into the color coordinates ($W_X'$, $W_Y'$, $W_Z'$) in the XYZ color system and RGB values $\{W_R', W_G', W_B'\}$ are calculated by applying the XYZ-RGB conversion matrix $M^{-1}$ obtained at step S02 to the color coordinates ($W_X'$, $W_Y'$, $W_Z'$). More specifically, the color coordinates ($W_X'$, $W_Y'$, $W_Z'$) and the RGB values $\{W_R', W_G', W_B'\}$ are calculated in accordance with the following expressions (10a) to (10c):

$$W_X' = W_Y' \times W_x' \div W_y', \tag{10a}$$

$$W_Z' = W_Y' \times (1 - W_x' - W_y') \div W_y', \text{ and} \tag{10b}$$

$$\begin{pmatrix} W_R' \\ W_G' \\ W_B' \end{pmatrix} = M^{-1} \begin{pmatrix} W_X' \\ W_Y' \\ W_Z' \end{pmatrix}, \tag{10c}$$

where $W_R'$, $W_G'$ and $W_B'$ represent the ratio of the R, G and B grayscale values to display the white point with the chromaticity coordinates x and y specified by the sRGB specification, for the case when the gamma property is not taken into account.

This is followed by calculating RGB values $\{W_R^{NRM}, W_G^{NRM}, W_B^{NRM}\}$ by normalizing the RGB values $\{W_R', W_G', W_B'\}$ with the allowed maximum grayscale value (in the present embodiment, "255".) For example, when $W_R'$ is the largest of $W_R'$, $W_G'$, $W_B'$, the R grayscale value $W_R^{NRM}$ is determined as "255" and the G and B grayscale value $W_G^{NRM}$ and $W_B^{NRM}$ are calculated in accordance with the following expressions (11a) and (11b):

$$W_G^{NRM}=255\times(W_G'/W_R'), \text{ and} \tag{11a}$$

$$W_B^{NRM}=255\times(W_B'/W_R'). \tag{11b}$$

A similar normalization is performed for the cases when $W_G'$ is the largest and when $W_B'$ is the largest. The RGB values $\{W_R^{NRM}, W_G^{NRM}, W_B^{NRM}\}$ are the R, G and B grayscale values to display the white point with the chromaticity coordinates x and y specified by the sRGB specification, for the case when the gamma property is not taken into account.

This is followed by calculating the desired RGB values ($W_R$, $W_G$, $W_B$) of the white point from the normalized RGV values $\{W_R^{NRM}, W_G^{NRM}, W_B^{NRM}\}$. The desired RGB values ($W_R$, $W_G$, $W_B$) of the white point are determined so as to display the white point with the chromaticity coordinates x and y specified by the sRGB specification, on the ground of the gamma property. In the present embodiment, the desired RGB values ($W_R$, $W_G$, $W_B$) of the white point are determined through searching described in the following.

In the searching of the R grayscale value $W_R$, the value $W_R^{tmp}$ defined by the following expression (12a) is calculated for each of the grayscale values n equal to or less than the allowed maximum grayscale value:

$$W_R^{tmp} = RGB_{MAX} \times \left(\frac{n}{RGB_{MAX}}\right)^{R\gamma_n}, \tag{12a}$$

where $RGB_{MAX}$ is the allowed maximum grayscale value, in the present embodiment, 255, and $R\gamma_n$ is the gamma value of the grayscale value n with respect to the elementary color R, which is calculated at step S03. It should be noted that expression (12a) corresponds to the expression to express the gamma property. The R grayscale value $W_R$ is determined as the grayscale value n determined so that the value $W_R^{tmp}$ is closest to the R grayscale value $W_R^{NRM}$. For example, when the value $W_R^{tmp}$ is closest to the R grayscale value $W_R^{NRM}$ for n being "255", the R grayscale value $W_R$ is determined as "255."

The searching of the G grayscale value $W_G$ and B grayscale value $W_B$ is achieved in a similar way. In the searching of the G grayscale value $W_G$, the value $W_G^{tmp}$ defined by the following expression (12b) is calculated for each of the grayscale values n equal to or less than the allowed maximum grayscale value:

$$W_G^{tmp} = RGB_{MAX} \times \left(\frac{n}{RGB_{MAX}}\right)^{G\gamma_n}, \tag{12b}$$

where $G\gamma_n$ is the gamma value of the grayscale value n with respect to the elementary color G, which is calculated at step S03. The G grayscale value $W_G$ is determined as the grayscale value n determined so that the value $W_G^{tmp}$ is closest to the G grayscale value $W_G^{NRM}$. Similarly, in the searching of the B grayscale value $W_B$, the value $W_B^{tmp}$ defined by the following expression (12c) is calculated for each of the grayscale values n equal to or less than the allowed maximum grayscale value:

$$W_B^{tmp} = RGB_{MAX} \times \left(\frac{n}{RGB_{MAX}}\right)^{B\gamma_n}, \tag{12c}$$

where $B\gamma_n$ is the gamma value of the grayscale value n with respect to the elementary color B, which is calculated at step S03. The B grayscale value $W_B$ is determined as the grayscale value n determined so that the value $W_B^{tmp}$ is closest to the G grayscale value $W_B^{NRM}$.

(Step S05)

This is followed by calculating R, G and B grayscale values to display each of adjustment target colors with desired chromaticity coordinates and a desired relative luminance. The R, G and B grayscale values to display a color with desired chromaticity coordinates and a desired relative luminance referred to herein means the R, G and B grayscale values to display the color on the liquid crystal display panel 1 with the desired chromaticity coordinates and the desired relative luminance, when the image data of the R, G and B grayscale values is supplied to the analog processing circuit 14. The relative luminance referred herein means the luminance with respect to that of the white point. In the present embodiment, in which the desired color gamut is that specified by the sRGB specification, The R, G and B grayscale values to display each of the adjustment target colors with the chromaticity coordinates and relative luminance which are specified by the sRGB specification or obtained from the sRGB specification. In the following, the R, G and B grayscale values to display a certain adjustment target color with the desired chromaticity coordinates and relative luminance are referred to as "desired RGB values of the adjustment target color".

In the present embodiment, the R elementary color point, G elementary color point, B elementary color point, C complementary color point, M complementary color point and Y complementary color point are selected as the adjustment target colors. In other words, desired RGB values are calculated for each of the R elementary color point, G elementary color point, B elementary color point, C complementary color point, M complementary color point and Y complementary color.

In the following, a description is first given of the calculation of the desired RGB values ($R_R$, $R_G$, $R_B$) of the R elementary color point. The chromaticity coordinates of the R elementary color point obtained from the sRGB specification is referred to as ($R_Y'$, Rx', Ry'), in the following. The chromaticity coordinates of the R elementary color point are described in the Yxy color system. In other word, $R_Y'$ represents the luminance Y (stimulus value Y) of the R elementary color point specified by the sRGB specification and Rx' and Ry' represents the chromaticity coordinates x and y of the R elementary color point specified by the sRGB specification, respectively.

First, the chromaticity coordinates ($R_Y'$, Rx', Ry') of the R elementary color point specified by the sRGB specification are converted into the color coordinates ($R_X'$, $R_Y'$, $R_Z'$) in the XYZ color system and RGB values $\{R_R', R_G', R_B'\}$ are calculated by applying the XYZ-RGB conversion matrix $M^{-1}$ obtained at step S02 to the color coordinates ($R_X'$, $R_Y'$, $R_Z'$). More specifically, the color coordinates ($R_X'$, $R_Y'$, $R_Z'$) and the RGB values $\{R_R', R_G', R_B'\}$ are calculated in accordance with the following expressions (13a) to (13c):

$$R'_X = R'_Y \times R'_x \div R'_y, \tag{13a}$$

$$R'_Z = R'_Y \times (1 - R'_x - R'_y) \div R'_y, \text{ and} \tag{13b}$$

$$\begin{pmatrix} R'_R \\ R'_G \\ R'_B \end{pmatrix} = M^{-1} \begin{pmatrix} R'_X \\ R'_Y \\ R'_Z \end{pmatrix}, \tag{13c}$$

$R_R'$, $R_G'$ and $R_B'$ represent the ratio of the R, G and B grayscale values to display the R elementary color point with the chromaticity coordinates x and y specified by the sRGB specification, for the case when the gamma property is not taken into account.

This is followed by calculating RGB values $\{R_R^{NRM}, R_G^{NRM}, R_B^{NRM}\}$ by normalizing the RGB values $\{R_R', R_G', R_B'\}$ with the allowed maximum grayscale value (in the present embodiment, "255".) The RGB values $\{R_R^{NRM}, R_G^{NRM}, R_B^{NRM}\}$ are the R, G and B grayscale values to display the R elementary color point with the chromaticity coordinates x and y specified by the sRGB specification, for the case when the gamma property is not taken into account.

It should be noted that the RGB values $\{R_R^{NRM}, R_G^{NRM}, R_B^{NRM}\}$ obtained through this normalization are not determined to achieve the relative luminance defined by the sRGB specification, although the ratio of the R, G and B grayscale values are kept to display the R elementary color point with the chromaticity coordinates x and y specified by the sRGB specification. To address this, RGB values $\{R_R'', R_G'', R_B''\}$ are calculated by multiplying the RGB grayscale values $\{R_R^{NRM}, R_G^{NRM}, R_B^{NRM}\}$ by a correction coefficient $R^L{}_G$ in the present embodiment. The RGB values $\{R_R'', R_G'', R_B''\}$ are the R, G and B grayscale values to display the R elementary color point with the chromaticity coordinates x and y and the relative luminance specified by the sRGB specification, for the case when the gamma property is not taken into account.

The correction coefficient $R^L{}_G$ is calculated in accordance with the following expression (14a):

$$R^L{}_G = (R_Y'/W_Y')/(R_Y^{NRM}/W_Y^{NRM}), \tag{14a}$$

where $W_Y'$ is the luminance Y (stimulus value Y) of the white point specified by the sRGB specification, and $R_Y'$ is the luminance Y of the R elementary color point specified by the sRGB specification. $W_Y^{NRM}$ is the luminance Y obtained from the RGB values $\{W_R^{NRM}, W_G^{NRM}, W_B^{NRM}\}$, which is calculated in accordance with the following expression (15a):

$$W_Y^{NRM} = r \cdot W_R^{NRM} + g \cdot W_G^{NRM} + b \cdot W_B^{NRM}, \tag{15a}$$

where r, g and b are parameters obtained in the calculation of the RGB-XYZ conversion matrix at step S02. It should be noted that expression (15a) is obtained by substituting the RGB values $\{(W_R^{NRM}, W_G^{NRM}, W_B^{NRM}\}$ into expression (2b). Similarly, $R_Y^{NRM}$ is the luminance Y obtained from the RGB values $\{R_R^{NRM}, R_G^{NRM}, R_B^{NRM}\}$, which is calculated in accordance with the following expression (15b):

$$R_Y^{NRM} = r \cdot W_R^{NRM} + g \cdot W_G^{NRM} + b \cdot W_B^{NRM}. \tag{15b}$$

The RGB values $\{R_R'', R_G'', R_B''\}$ are calculated with the correction coefficient $R^L{}_G$ in accordance with the following expressions (16a) to (16c):

$$R_R''=R^L{}_G \cdot R_R^{NRM}, \tag{16a}$$

$$R_G''=R^L{}_G \cdot R_G^{NRM}, \text{ and} \tag{16b}$$

$$R_B''=R^L{}_G \cdot R_B^{NRM}. \tag{16c}$$

This is followed by calculating the desired RGB values ($R_R$, $R_G$, $R_B$) of the R elementary color point from the RGB values {$R_R''$, $R_G''$, $R_B''$ }, which are obtained from the correction with the correction coefficient $R^L{}_G$. The desired RGB values ($R_R$, $R_G$, $R_B$) of the R elementary color point are determined so as to display the R elementary color point with the chromaticity coordinates x and y specified by the sRGB specification, on the ground of the gamma property. In the present embodiment, the desired RGB values ($R_R$, $R_G$, $R_B$) of the R elementary color point are determined through searching described in the following.

In the searching of the R grayscale value $R_R$, the value $R_R^{tmp}$ defined by the following expression (17a) is calculated for each of the grayscale values n equal to or less than the allowed maximum grayscale value:

$$R_R^{tmp} = RGB_{MAX} \times \left(\frac{n}{RGB_{MAX}}\right)^{R\gamma_n}, \tag{17a}$$

where $RGB_{MAX}$ is the allowed maximum grayscale value, in the present embodiment, 255, and $R\gamma_n$ is the gamma value of the grayscale value n with respect to the elementary color R, which is calculated at step S03. It should be noted that expression (17a) corresponds to the expression to express the gamma property. The R grayscale value $R_R$ is determined as the grayscale value n determined so that the value $R_R^{tmp}$ is closest to the R grayscale value $R_R''$. For example, when the value $R_R^{tmp}$ is closest to the R grayscale value $R_R''$ for n being "255", the R grayscale value $R_R$ is determined as "255."

The searching of the G grayscale value $R_G$ and B grayscale value $R_B$ is achieved in a similar way. In the searching of the G grayscale value $R_G$, the value $R_G^{tmp}$ defined by the following expression (17b) is calculated for each of the grayscale values n equal to or less than the allowed maximum grayscale value:

$$R_G^{tmp} = RGB_{MAX} \times \left(\frac{n}{RGB_{MAX}}\right)^{G\gamma_n}, \tag{17b}$$

where $G\gamma_n$ is the gamma value of the grayscale value n with respect to the elementary color G, which is calculated at step S03. The G grayscale value $R_G$ is determined as the grayscale value n determined so that the value $R_G^{tmp}$ is closest to the G grayscale value $R_G''$. Similarly, in the searching of the B grayscale value $R_B$, the value $R_B^{tmp}$ defined by the following expression (17c) is calculated for each of the grayscale values n equal to or less than the allowed maximum grayscale value:

$$R_B^{tmp} = RGB_{MAX} \times \left(\frac{n}{RGB_{MAX}}\right)^{B\gamma_n}, \tag{17c}$$

where $B\gamma_n$ is the gamma value of the grayscale value n with respect to the elementary color B, which is calculated at step S03. The B grayscale value $R_B$ is determined as the grayscale value n determined so that the value $R_B^{tmp}$ is closest to the B grayscale value $R_B''$.

It should be noted that the R, G and B grayscale values $R_R$, $R_G$ and $R_B$ may be determined as the grayscale values n determined so that the values $R_R^{tmp}$, $R_G^{tmp}$ and $R_B^{tmp}$ defined by expressions (17a) to (17c) are closest to $R^L{}_G \cdot R_R^{NRM}$, $R^L{}_G \cdot R_G^{NRM}$ and $R^L{}_G \cdot R_B^{NRM}$, respectively, in the searching of the desired RGB values {$R_R$, $R_G$, $R_B$}.

The desired RGB values for the other adjustment target colors, that is, the R, G and B grayscale values to display the other adjustment target colors with the chromaticity coordinates x, y and relative luminance specified by the sRGB specification are calculated in a similar process.

For example, the desired RGB values {$G_R$, $G_G$, $G_B$} of the G elementary color point are calculated by performing a similar process using the chromaticity coordinates ($G_Y'$, Gx', Gy') of the G elementary color point obtained from the sRGB specification in place of the chromaticity coordinates ($R_Y'$, Rx', Ry') of the R elementary color point obtained from the sRGB specification. More specifically, the chromaticity coordinates ($G_Y'$, Gx', Gy') of the G elementary color point specified by the sRGB specification are converted into the color coordinates ($G_X'$, $G_Y'$, $G_Z'$) in the XYP color system, and RGB values {$G_R'$, $G_G'$, $G_B'$} are calculated by applying the XYZ-RGB conversion matrix $M^{-1}$ to the color coordinates ($G_X'$, $G_Y'$, $G_Z'$). This is followed by calculating RGB values {$G_R^{NRM}$, $G_G^{NRM}$, $G_B^{NRM}$} by normalizing the RGB values {$G_R'$, $G_G'$, $G_B'$} and calculating a correction coefficient $G^L{}_G$ used for adjusting the relative luminance. The correction coefficient $G^L{}_G$ is calculated in accordance with the following expression (14b) on the basis of the luminance $W_Y'$ of the white point specified by the sRGB specification, the luminance $G_Y'$ of the G elementary color point specified by the sRGB specification, the luminance $W_Y^{NRM}$ obtained from the RGB values {$W_R^{NRM}$, $W_G^{NRM}$, $W_B^{NRM}$} by using the parameters r, g and b, and the luminance $G_Y^{NRM}$ obtained from the RGB values {$G_R^{NRM}$, $G_G^{NRM}$, $G_B^{NRM}$} by using the parameters r, g and b:

$$G^L{}_G=(G_Y'/W_Y')/(G_Y^{NRM}/W_Y^{NRM}). \tag{14b}$$

Furthermore, RGB values {$G_R''$, $G_G''$, $G_B''$ } are calculated by multiplying the RGB values {$G_R^{NRM}$, $G_G^{NRM}$, $G_B^{NRM}$} by the correction coefficient $G^L{}_G$. Finally, the desired RGB values {$G_R$, $G_G$, $G_B$} of the G elementary color are determined by performing searching similar to that of the desired RGB values {$R_R$, $R_G$, $R_B$} of the R elementary color, using the RGB values {$G_R''$, $G_a''$, $G_B''$ } in place of the RGB values {$R_R''$, $R_G''$, $R_B''$}.

Similarly, the desired RGB values {$B_R$, $B_G$, $B_B$} of the B elementary color point are calculated by performing a similar process using the chromaticity coordinates ($B_Y'$, Bx', By') of the B elementary color point obtained from the sRGB specification in place of the chromaticity coordinates ($R_Y'$, Rx', Ry') obtained from the sRGB specification. More specifically, the chromaticity coordinates ($B_Y'$, Bx', By') of the B elementary color point specified by the sRGB specification are converted into the color coordinates ($B_X'$, $B_Y'$, $B_Z'$) in the XYP color system, and RGB values {$B_R'$, $B_G'$, $B_B'$} are calculated by applying the XYZ-RGB conversion matrix $M^{-1}$ to the color coordinates ($B_X'$, $B_Y'$, $B_Z'$). This is followed by calculating RGB values {$B_R^{NRM}$, $B_G^{NRM}$, $B_B^{NRM}$} by normalizing the RGB values {$B_R'$, $B_G'$, $B_B'$} and also calculating a correction coefficient $B^L{}_G$ used for adjusting the relative luminance. The correction coefficient $B^L{}_G$ is calculated in accordance with the following expression (14c) on the basis of the luminance $W_Y'$ of the white point specified by the sRGB specification, the luminance $B_Y'$ of the B elementary color point specified by the sRGB specification, the luminance $W_Y^{NRM}$ obtained from the RGB values $\{W_R^{NRM}, W_G^{NRM}, W_B^{NRM}\}$ by using the parameters r, g and b, and the luminance $B_Y^{NRM}$ obtained from the RGB values $\{B_R^{NRM}, B_G^{NRM}, B_B^{NRM}\}$ by using the parameters r, g and b:

$$B^L{}_G=(B_Y'/W_Y')/(B_Y^{NRM}/W_Y^{NRM}). \tag{14c}$$

Furthermore, RGB values $\{B_R'', B_G'', B_B''\}$ are calculated by multiplying the RGB values $\{B_R^{NRM}, B_G^{NRM}, B_B^{NRM}\}$ by the correction coefficient $B^L{}_G$. Finally, the desired RGB values $\{B_R, B_G, B_B\}$ of the B elementary color are determined by performing searching similar to that of the desired RGB values $\{R_R, R_G, R_B\}$ of the R elementary color, using the RGB values $\{B_R'', B_G'', B_B''\}$ in place of the RGB values $\{R_R'', R_G'', R_B''\}$.

Similarly, the desired RGB values $\{C_R, C_G, C_B\}$ of the C complementary color point are calculated by performing a similar process using the chromaticity coordinates ($C_Y'$, Cx', Cy') of the C complementary color point obtained from the sRGB specification in place of the chromaticity coordinates ($R_Y'$, Rx', Ry') of the R elementary color point obtained from the sRGB specification. More specifically, the chromaticity coordinates ($C_Y'$, Cx', Cy') of the C complementary color point specified by the sRGB specification are converted into the color coordinates ($C_X'$, $C_Y'$, $C_Z'$) in the XYP color system, and RGB values $\{C_R', C_G', C_B'\}$ are calculated by applying the XYZ-RGB conversion matrix $M^{-1}$ to the color coordinates ($C_X'$, $C_Y'$, $C_Z'$). This is followed by calculating RGB values $\{C_R^{NRM}, C_G^{NRM}, C_B^{NRM}\}$ by normalizing the RGB values $\{C_R', C_G', C_B'\}$ and calculating a correction coefficient $C^L{}_G$ used for adjusting the relative luminance. The correction coefficient $C^L{}_G$ is calculated in accordance with the following expression (14d) on the basis of the luminance $W_Y'$ of the white point specified by the sRGB specification, the luminance $C_Y'$ of the C complementary color point specified by the sRGB specification, the luminance $W_Y^{NRM}$ obtained from the RGB values $\{W_R^{NRM}, W_G^{NRM}, W_B^{NRM}\}$ by using the parameters r, g and b, and the luminance $C_Y^{NRM}$ obtained from the RGB values $\{C_R^{NRM}, C_G^{NRM}, C_B^{NRM}\}$ by using the parameters r, g and b:

$$C^L{}_G=(C_Y'/W_Y')/(C_Y^{NRM}/W_Y^{NRM}). \tag{14d}$$

Furthermore, RGB values $\{C_R'', C_G'', C_B''\}$ are calculated by multiplying the RGB values $\{C_R^{NRM}, C_G^{NRM}, C_B^{NRM}\}$ by the correction coefficient $C^L{}_G$. Finally, the desired RGB values $\{C_R, C_G, C_B\}$ of the C complementary color are determined by performing searching similar to that of the desired RGB values $\{R_R, R_G, R_B\}$ of the R elementary color, using the RGB values $\{C_R'', C^{G''}, C_B''\}$ in place of the RGB values $\{R_R'', R_G'', R_B''\}$.

Similarly, the desired RGB values $\{M_R, M_G, M_B\}$ of the M complementary color point are calculated by performing a similar process using the chromaticity coordinates ($M_Y'$, Mx', My') of the M complementary color point obtained from the sRGB specification in place of the chromaticity coordinates ($R_Y'$, Rx', Ry') of the R elementary color point obtained from the sRGB specification. More specifically, the chromaticity coordinates ($M_Y'$, Mx', My') of the M complementary color point specified by the sRGB specification are converted into the color coordinates ($M_X'$, $M_Y'$, $M_Z'$) in the XYP color system, and RGB values $\{M_R', M_G', M_B'\}$ are calculated by applying the XYZ-RGB conversion matrix $M^{-1}$ to the color coordinates ($M_X'$, $M_Y'$, $M_Z'$). This is followed by calculating RGB values $\{M_R^{NRM}, M_G^{NRM}, M_B^{NRM}\}$ by normalizing the RGB values $\{M_R', M_G', M_B'\}$ and calculating a correction coefficient $M^L{}_G$ used for adjusting the relative luminance. The correction coefficient $M^L{}_G$ is calculated in accordance with the following expression (14e) on the basis of the luminance $W_Y'$ of the white point specified by the sRGB specification, the luminance $M_Y'$ of the M complementary color point specified by the sRGB specification, the luminance $W_Y^{NRM}$ obtained from the RGB values $\{W_R^{NRM}, W_G^{NRM}, W_B^{NRM}\}$ by using the parameters r, g and b, and the luminance $M_Y^{NRM}$ obtained from the RGB values $\{M_R^{NRM}, M_G^{NRM}, M_B^{NRM}\}$ by using the parameters r, g and b:

$$M^L{}_G=(M_Y'/W_Y')/(M_Y^{NRM}/W_Y^{NRM}). \tag{14e}$$

Furthermore, RGB values $\{M_R'', M_G'', M_B''\}$ are calculated by multiplying the RGB values $\{M_R^{NRM}, M_G^{NRM}, M_B^{NRM}\}$ by the correction coefficient $M^L{}_G$. Finally, the desired RGB values $\{M_R, M_G, M_B\}$ of the M complementary color are determined by performing searching similar to that of the desired RGB values $\{R_R, R_G, R_B\}$ of the R elementary color, using the RGB values $\{M_R'', M_G'', M_B''\}$ in place of the RGB values $\{R_R'', R_G'', R_B''\}$.

Similarly, the desired RGB values $\{Y_R, Y_G, Y_B\}$ of the Y complementary color point are calculated by performing a similar process using the chromaticity coordinates ($Y_Y'$, Yx', Yy') of the Y complementary color point obtained from the sRGB specification in place of the chromaticity coordinates ($R_Y'$, Rx', Ry') of the R elementary color point obtained from the sRGB specification. More specifically, the chromaticity coordinates ($Y_Y'$, Yx', Yy') of the Y complementary color point specified by the sRGB specification are converted into the color coordinates ($Y_X'$, $Y_Y'$, $Y_Z'$) in the XYP color system, and RGB values $\{Y_R', Y_G', Y_B'\}$ are calculated by applying the XYZ-RGB conversion matrix $M^{-1}$ to the color coordinates ($Y_X'$, $Y_Y'$, $Y_Z'$). This is followed by calculating RGB values $\{Y_R^{NRM}, Y_G^{NRM}, Y_B^{NRM}\}$ by normalizing the RGB values $\{Y_R', Y_G', Y_B'\}$ and calculating a correction coefficient $Y^L{}_G$ used for adjusting the relative luminance. The correction coefficient $Y^L{}_G$ is calculated in accordance with the following expression (14f) on the basis of the luminance $W_Y'$ of the white point specified by the sRGB specification, the luminance $Y_Y'$ of the Y complementary color point specified by the sRGB specification, the luminance $W_Y^{NRM}$ obtained from the RGB values $\{W_R^{NRM}, W_G^{NRM}, W_B^{NRM}\}$ by using the parameters r, g and b, and the luminance $Y_Y^{NRM}$ obtained from the RGB values $\{Y_R^{NRM}, Y_G^{NRM}, Y_B^{NRM}\}$ by using the parameters r, g and b:

$$Y^L{}_G=(Y_Y'/W_Y')/(Y_Y^{NRM}/W_Y^{NRM}). \tag{14f}$$

Furthermore, RGB values $\{Y_R'', Y_G'', Y_B''\}$ are calculated by multiplying the RGB values $\{Y_R^{NRM}, Y_G^{NRM}, Y_B^{NRM}\}$ by the correction coefficient $Y^L{}_G$. Finally, the desired RGB values $\{Y_R, Y_G, Y_B\}$ of the Y complementary color are determined by performing searching similar to that of the desired RGB values $\{R_R, R_G, R_B\}$ of the R elementary color, using the RGB values $\{Y_R'', Y_G'', Y_B''\}$ in place of the RGB values $\{R_R'', R_G'', R_B''\}$.

It should be noted that it is not necessary that the correction coefficients for the correction of the relative luminance ($R^L{}_G$, $G^L{}_G$, $B^L{}_G$, $C^L{}_G$, $M^L{}_G$ and $Y^L{}_G$), which are used in the calculation of the desired RGB values, are calculated in accordance with the sRGB specification. The coloring of an image may be adjusted depending on the user's preference, if the color gamut is properly adjusted. Accordingly, the correction coefficients for the correction of the relative luminance may be properly set in accordance with the preference of the manufacturer or user of the display apparatus 10.

(Step S06)

This is followed by calculating the correction parameters to be set to the color correction circuit 30, from the desired RGB values of the white color and the respective adjustment target colors calculated at steps S04 and S05. FIG. 6 is a table illustrating the input-output relation to be set to the color correction circuit 30 by the correction parameters.

The correction parameters to be set to the color correction circuit 30 are determined so that the desired RGB values of the white point and the respective adjustment target colors are output from the color correction circuit 30, when the image data corresponding to the white point and the respective adjustment target colors are supplied to the color correction circuit 30. More specifically, the correction parameters to be set to the color correction circuit 30 are calculated to satisfy the following requirements (1) to (7):

(1) The desired RGB values $\{W_R, W_G, W_B\}$ of the white point are output from the color correction circuit 30 when an image data corresponding to the white point (that is, an image data of RGB values {255, 255, 255}) are supplied to the color correction circuit 30 as the input.

(2) The desired RGB values $\{R_R, R_G, R_B\}$ of the R elementary color point are output from the color correction circuit 30 when an image data corresponding to the R elementary color point (that is, an image data of RGB values {255, 0, 0}) are supplied to the color correction circuit 30 as the input.

(3) The desired RGB values $\{G_R, G_G, G_B\}$ of the G elementary color point are output from the color correction circuit 30 when an image data corresponding to the G elementary color point (that is, an image data of RGB values {0, 255, 0}) are supplied to the color correction circuit 30 as the input.

(4) The desired RGB values $\{B_R, B_G, B_B\}$ of the B elementary color point are output from the color correction circuit 30 when an image data corresponding to the B elementary color point (that is, an image data of RGB values {0, 0, 255}) are supplied to the color correction circuit 30 as the input.

(5) The desired RGB values $\{C_R, C_G, C_B\}$ of the C complementary color point are output from the color correction circuit 30 when an image data corresponding to the C complementary color point (that is, an image data of RGB values {0, 255, 255}) are supplied to the color correction circuit 30 as the input.

(6) The desired RGB values $\{M_R, M_G, M_B\}$ of the M complementary color point are output from the color correction circuit 30 when an image data corresponding to the M complementary color point (that is, an image data of RGB values {255, 0, 255}) are supplied to the color correction circuit 30 as the input.

(7) The desired RGB values $\{Y_R, Y_G, Y_B\}$ of the Y complementary color point are output from the color correction circuit 30 when an image data corresponding to the Y complementary color point (that is, an image data of RGB values {255, 255, 0}) are supplied to the color correction circuit 30 as the input.

The correction parameters calculated by the processing unit 4 of the color adjustment apparatus 20 as described above are written into the non-volatile memory 15 of the display driver 2 via the interface control circuit 11. When the display apparatus 10 is operated, the correction parameters read out from the non-volatile memory 15 are supplied to the color correction circuit 30. The color correction circuit 30 performs digital processing for the color adjustment on the basis of the correction parameters. This effectively achieves desired color adjustment.

Although the above-described embodiment recites that the desired RGB values are calculated for each of the R elementary color point, G elementary color point, B elementary color point, C complementary color point, M complementary color point and Y complementary color point, it is not necessary to calculate desired RGB values for the C, M and Y complementary color points in view of the adjustment of the color gamut. In this case, the correction parameters to be set to the color correction circuit 30 are calculated so that the desired RGB values of the white point and the R, G and B elementary color points are output from the color correction circuit 30, when image data corresponding to the white point and the R, G and B elementary color points are supplied to the color correction circuit 30.

Although the above-described embodiment recites that the correction parameters to be set to the color correction circuit 30 are calculated by the processing unit 4 of the color adjustment apparatus 20 and the calculated correction parameters are written into the non-volatile memory 15 of the display driver 2 from the color adjustment apparatus 20, the procedure of calculating and setting the correction parameters may be variously modified.

Figure 7A:
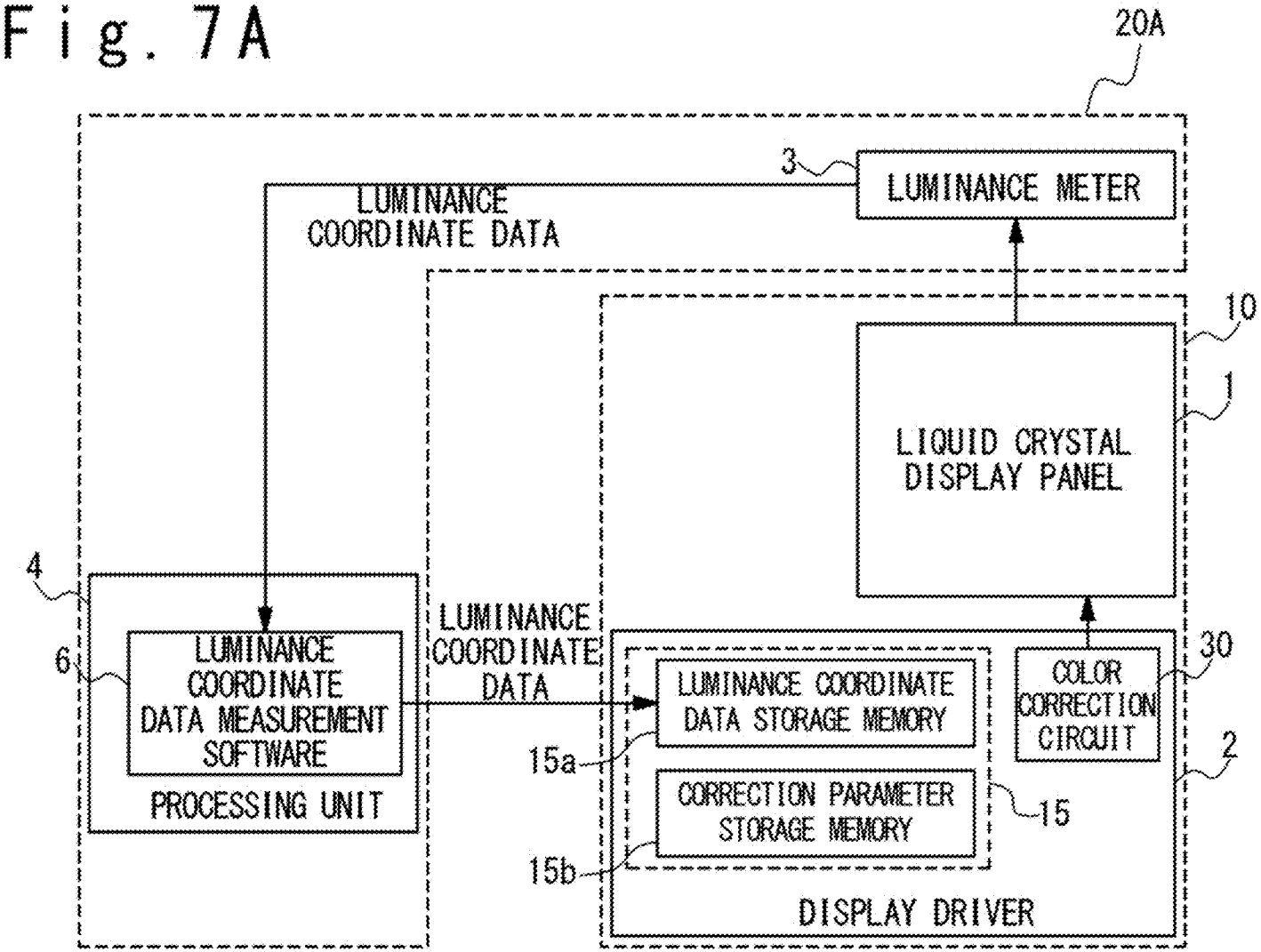
FIG. 7A is a block diagram schematically illustrating exemplary configurations of a luminance coordinate measurement apparatus and a display apparatus in another embodiment.
Figure 7B:
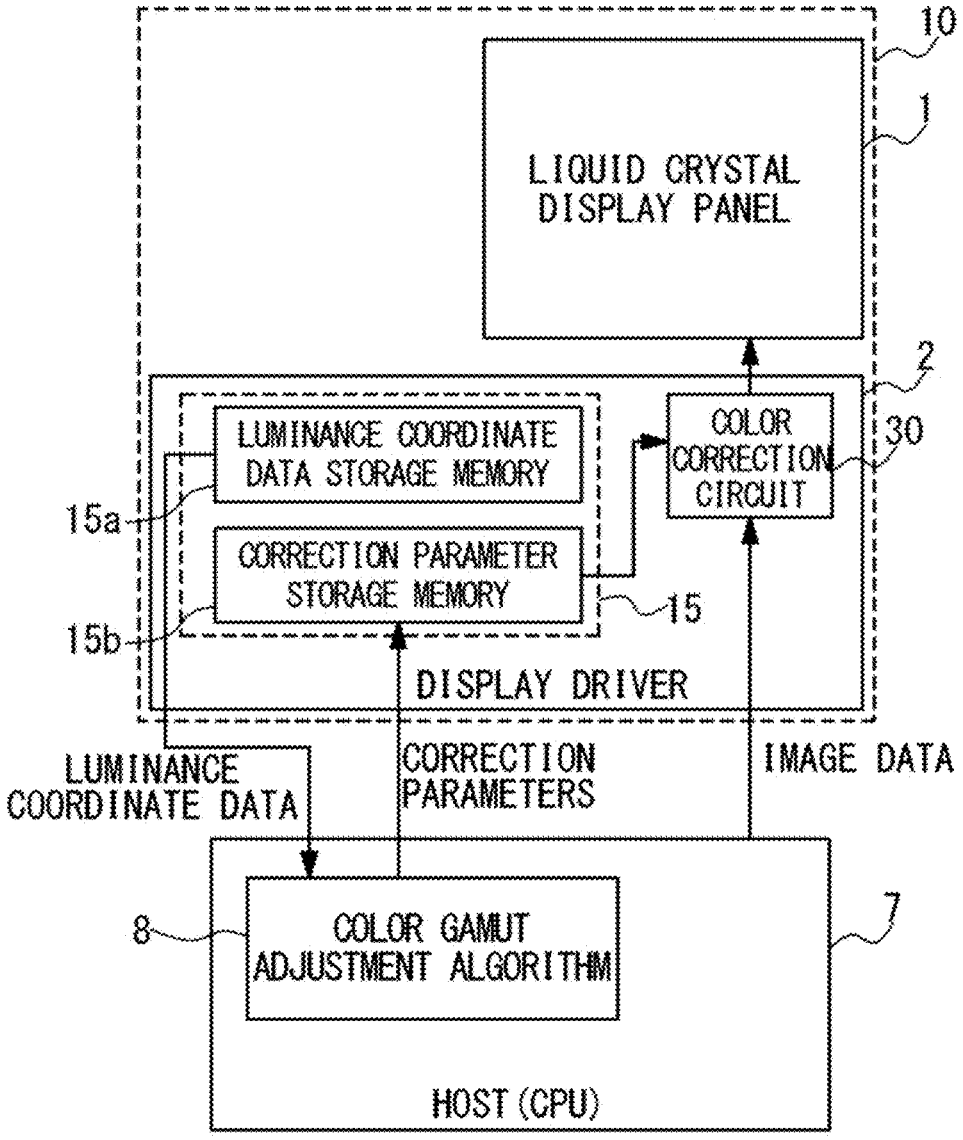
FIG. 7B is a block diagram schematically illustrating an exemplary configuration of a display system including the display apparatus illustrated in FIG. 7A.

FIGS. 7A and 7B are block diagrams schematically illustrates the configurations of a luminance coordinate measurement apparatus 20A and a display apparatus 10 in another embodiment. Referring to FIG. 7A, the luminance coordinate measurement apparatus 20A, which is configured to measure luminance coordinate data, is used in place of the color adjustment apparatus 20 in the present embodiment. Additionally, the non-volatile memory 15 of the display driver 2 includes a luminance coordinate data storage memory 15*a* storing therein the luminance coordinate data, and a correction parameter storage memory 15*b* storing therein the correction parameters.

The luminance coordinate measurement apparatus 20A include a luminance meter 3 and a processing unit 4 and luminance coordinate data measurement software 6 is installed on the processing unit 4. The measurement of the luminance coordinate data is achieved by executing the luminance coordinate data measurement software 6 by the processing unit 4. In the present embodiment, luminance coordinate data of the R, G and B elementary color points and the white point (that is, the luminance coordinate data of the R, G and B elementary colors and the write color of the allowed maximum grayscale values) and a luminance coordinate data corresponding to the white color of at least one intermediate grayscale value are measured, and the measured luminance coordinate data are written into the luminance coordinate data storage memory 15*a* of the display driver 2.

As illustrated in FIG. 7B, in an implementation of the display apparatus 10, a display system includes a host 7 and the display apparatus 10 in the present embodiment. In this display system, the correction parameters to be set to the color correction circuit 30 are calculated by the host 7, which is configured to supply image data to the display apparatus 10. More specifically, a software program implementing a color gamut adjustment algorithm 8 is installed on the host 7 and the correction parameters are calculated by executing the color gamut adjustment algorithm 8 by the host 7. In the calculation of the correction parameters, the luminance coordinate data stored in the luminance coordinate data storage memory 15*a* are read out and transferred from the display driver 2 to the host 7. The host 7 calculates the correction parameters to be set to the color correction circuit 30 from the luminance coordinate data received from the display driver 2, through the above-described procedure. The correction parameters calculated by the host 7 are transferred to the display driver 2 and written into the correction parameter storage memory 15*b* of the display driver 2. When the display driver 2 is operated, the correction parameters read out from the correction parameter storage memory 15*b* are supplied to the color correction circuit 30. The color correction circuit 30 performs digital processing for color adjustment on the basis of the correction parameters.

This configuration is helpful for allowing the user of the display apparatus 10 to achieve desired color adjustment. The manufacturer of the display apparatus 10 writes the luminance coordinate data measured by the luminance coordinate measurement apparatus 20A into the non-volatile memory 15 of the display driver 2. In this case, the user of the display apparatus 10 can achieve desired color adjustment with a higher preciseness by executing a desired color gamut adjustment algorithm 8 by the host 7.

Figure 8A:
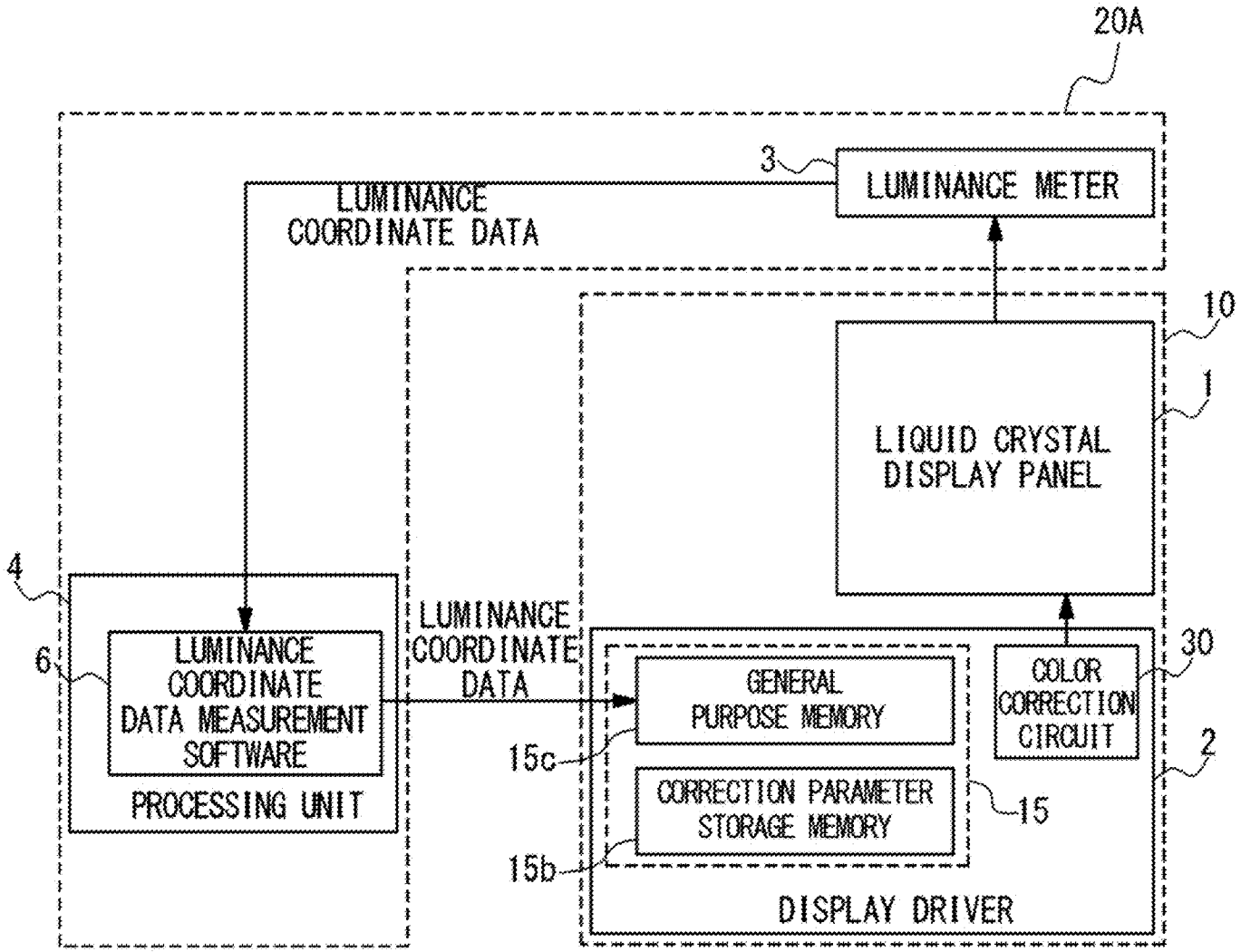
FIG. 8A is a block diagram schematically illustrating exemplary configurations of a luminance coordinate measurement apparatus and a display apparatus in still another embodiment.

FIG. 8A is a block diagram schematically illustrating the configurations of the luminance coordinate measurement apparatus 20A and the display apparatus 10 in still another embodiment. As illustrated in FIG. 8A, the non-volatile memory 15 includes a correction parameter storage memory 15*b* storing therein the correction parameters and a general-purpose memory 15*c* in the present embodiment. The luminance coordinate data measured by the luminance coordinate measurement apparatus 20A are written into the general-purpose memory 15*c* of the display driver 2.

Figure 8B:
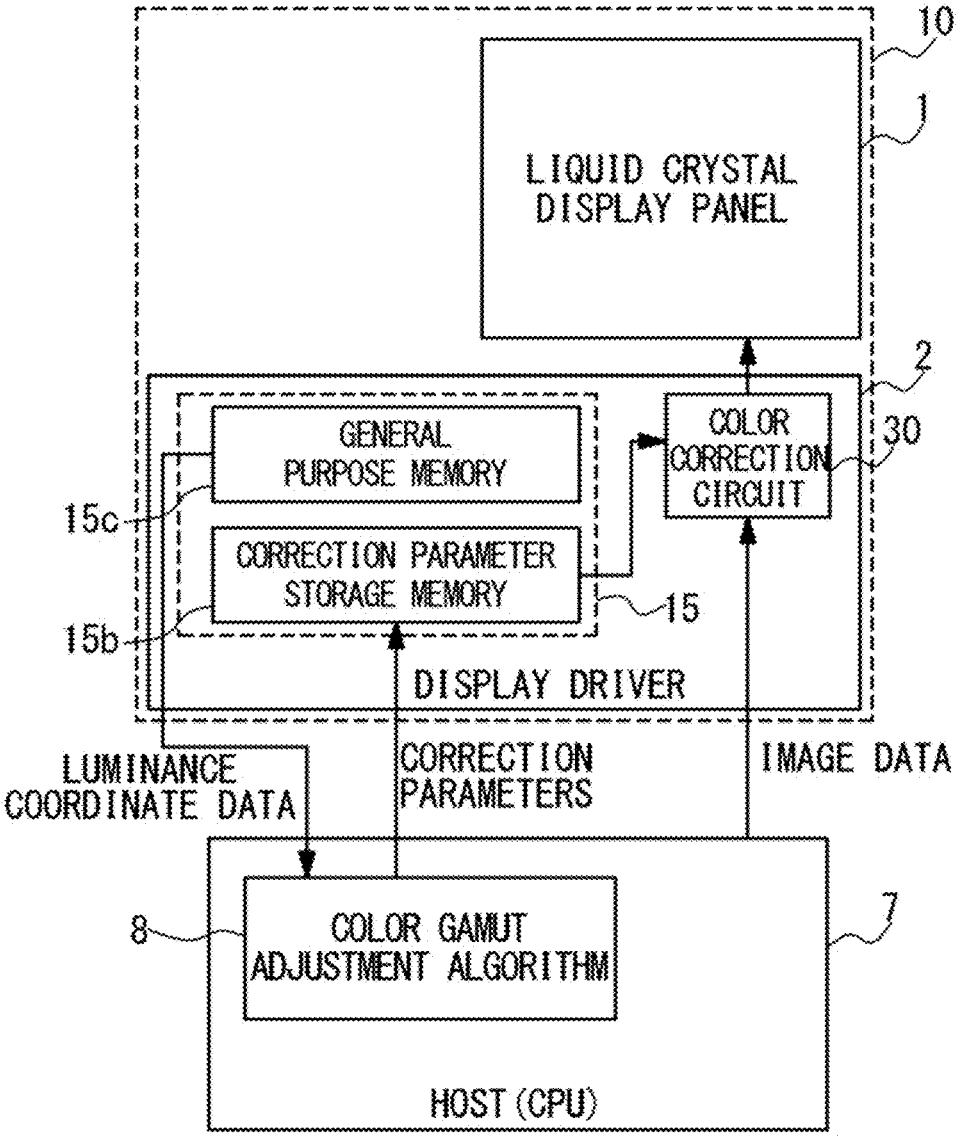
FIG. 8B is a block diagram schematically illustrating an exemplary configuration of a display system including the display apparatus illustrated in FIG. 8A.

As illustrated in FIG. 8B, in an implementation of the display apparatus 10, a display system includes a host 7 and the display apparatus 10 also in the present embodiment. In this display system, when the correction parameters are calculated, the luminance coordinate data stored in the general-purpose memory 15*c* are read out and transferred from the display driver 2 to the host 7. The host 7 calculates the correction parameters to be set to the color correction circuit 30 from the luminance coordinate data received from the display driver 2, through the above-described procedure. The correction parameters calculated by the host 7 are transferred to the display driver 2 and written into the correction parameter storage memory 15*b* of the display driver 2. From then on, the region of the general-purpose memory 15*c* into which the luminance coordinate data is written is opened to any purposes other than the storage of the luminance coordinate data.

This configuration allows efficient use of the non-volatile memory 15 of the display driver 2. It is not necessary to hold the luminance coordinate data after the calculation of the correction parameters of the color correction circuit 30 is completed. When the calculation of the correction parameters of the color correction circuit 30 is performed only once, use of the general-purpose memory 15*c*, which used to store the luminance coordinate data, for a purpose other than the storage of the luminance coordinate data after the completion of the calculation of the correction parameters allows efficient use of the non-volatile memory 15. It should be noted that the luminance coordinate data may be continuously stored in the general-purpose memory 15*c* to allow achieving color adjustment, that is, calculation of the correction parameters of the color correction circuit 30 at desired timing.

Figure 9A:
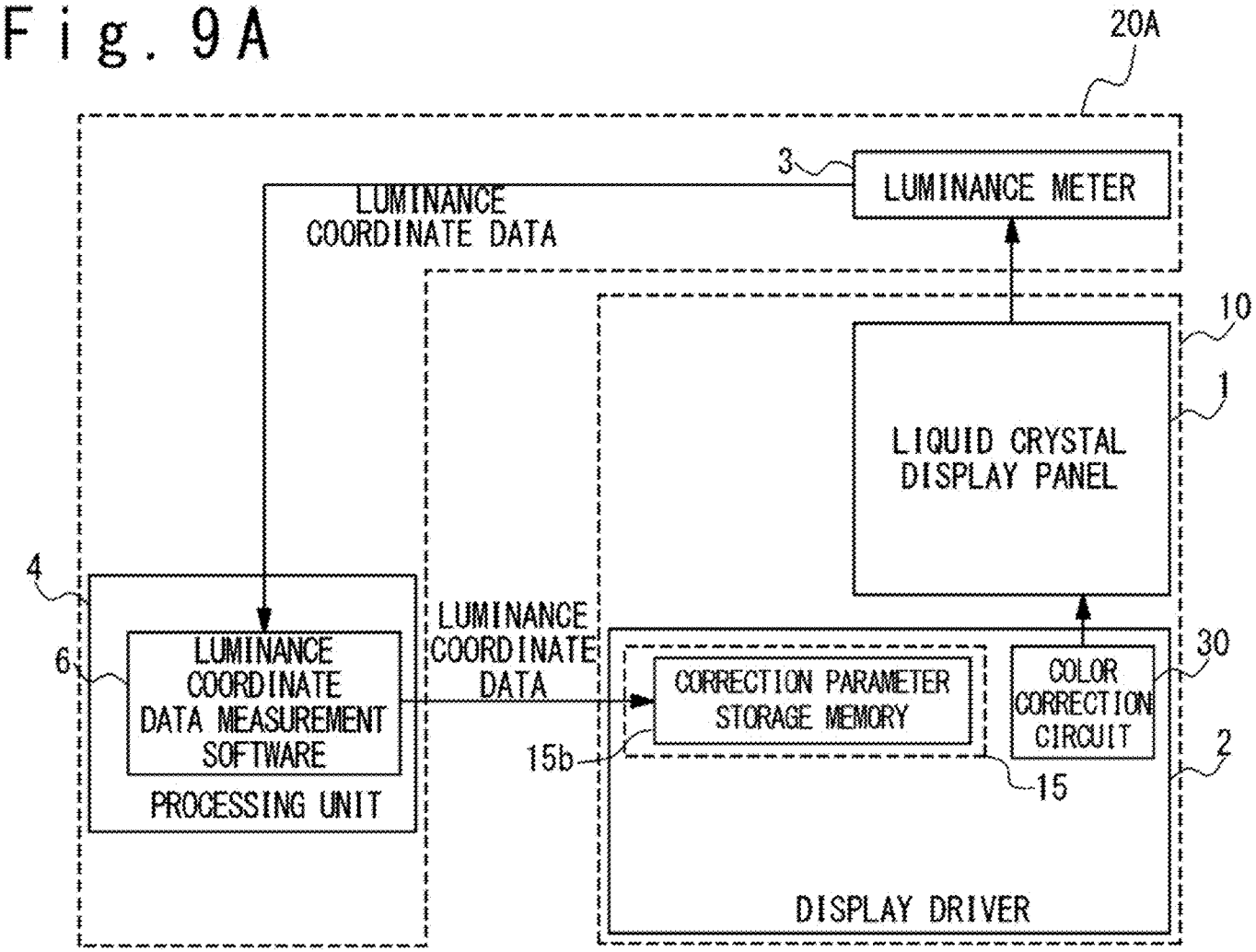
FIG. 9A is a block diagram schematically illustrating exemplary configurations of a luminance coordinate measurement apparatus and a display apparatus in still another embodiment.
Figure 9B:
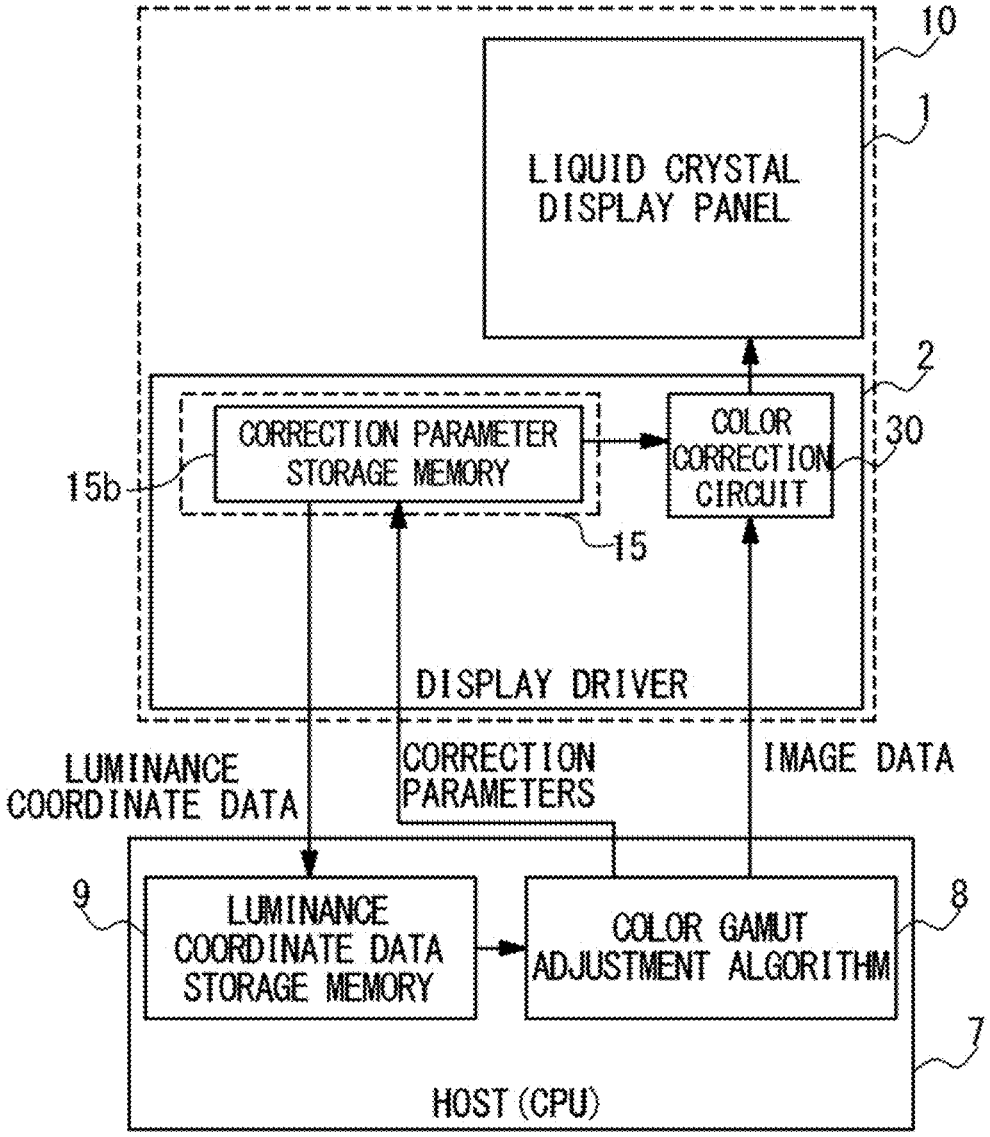
FIG. 9B is a block diagram schematically illustrating an exemplary configuration of a display system including the display apparatus illustrated in FIG. 9A.

FIGS. 9A and 9B are block diagrams schematically illustrating the configurations of the luminance coordinate measurement apparatus 20A and the display apparatus 10 in still another embodiment. In the present embodiment, the non-volatile memory 15 of the display driver 2 includes a correction parameter storage memory 15*b*. The luminance coordinate data obtained by the luminance coordinate measurement apparatus 20A are written into the correction parameter storage memory 15*b* of the display driver 2.

As illustrated in FIG. 9B, the host 7 includes a luminance coordinate data storage memory 9 in the present embodiment. When the correction parameters are calculated, the luminance coordinate data stored in the correction parameter storage memory 15*b* are transferred from the display driver 2 to the host 7 and written into the luminance coordinate data storage memory 9 of the host 7. The host 7 calculates the correction parameters to be set to the color correction circuit 30 on the basis of the luminance coordinate data stored in the luminance coordinate data storage memory 9, through the above-described procedure. The correction parameters calculated by the host 7 are transferred to the display driver 2 and written into the correction parameter storage memory 15*b* of the display driver 2. In the write operation of the correction parameters, the luminance coordinate data which have been stored in the correction parameter storage memory 15*b* are overwritten with the correction parameters. This configuration allows reducing the capacity of the non-volatile memory 15 of the display driver 2.

The luminance coordinate data stored in the luminance coordinate data storage memory 9 of the host 7 may be held or discarded after the calculation of the correction parameters. The luminance coordinate data may be continuously held in the luminance coordinate data storage memory 9 to perform color adjustment, which includes calculation of the correction parameters of the color correction circuit 30, at desired timing. When the correction parameters are calculated only once, the luminance coordinate data may be discarded after the calculation of the correction parameters. In this case, a general-purpose memory may be used as the luminance coordinate data storage memory 9. The general-purpose memory may be used for a purpose other than the storage of the luminance coordinate data, after the calculation of the correction parameters. Such configuration is preferable in view of efficient use of the memory resource.

Although various embodiments of the present disclosure have been specifically described, the present disclosure must not be construed as being limited to the above-described embodiment. It would be apparent to a person skilled in the art that the present disclosure may be implemented with various modifications.

What is claimed is:

1. A color adjustment method for a display apparatus including a display device, a color correction circuit, and drive circuitry configured to drive the display device, the method comprising:

measuring first luminance coordinate data for a color displayed on the display device when image data corresponding to a white point is supplied to the drive circuitry;

measuring second luminance coordinate data for a color displayed on the display device when image data corresponding to a white color of at least one intermediate grayscale value is supplied to the drive circuitry;

measuring third luminance coordinate data for respective colors displayed on the display device when image data corresponding to each of a plurality of elementary color points is supplied to the drive circuitry;

calculating, based on the first luminance coordinate data and on the second luminance coordinate data, first gamma values for the white color;

calculating, based on the first gamma values and on a conversion matrix indicating a property of the first luminance coordinate data and the third luminance coordinate data, second gamma values for at least one of a plurality of elementary colors;

calculating, using the second gamma values, desired values for displaying the white point and for displaying an adjustment target color; and calculating, based on the first luminance coordinate data, on the second luminance coordinate data, and on the third luminance coordinate data, correction parameters to be set to the color correction circuit, wherein the correction parameters configure the color correction circuit to output the desired values for displaying the white point responsive to the image data corresponding to the white point, and to output the desired values for displaying the adjustment target color responsive to image data corresponding to the adjustment target color.

2. The method according to claim 1, wherein the plurality of elementary color points comprises R, G, and B elementary color points, and wherein calculating the desired values comprises calculating desired RGB values of the white point and of the adjustment target color.

3. The method according to claim 2, wherein the conversion matrix comprises an XYZ-RGB conversion matrix, wherein calculating the second gamma values comprises calculating gamma values for an elementary color R, gamma values for an elementary color G, and gamma values for an elementary color B, and wherein calculating the desired RGB values of the white point and of the adjustment target color is based on the gamma values for the elementary color R, the gamma values for the elementary color G, and the gamma values for the elementary color B.

4. The method according to claim 3, wherein the adjustment target color includes the R, G, and B elementary color points, wherein calculating the desired RGB values of the white point is further based on desired chromaticity coordinates specified with respect to the white point, and wherein the desired RGB values of the R, G, and B elementary color points are calculated based on desired chromaticity coordinates specified for the R, G, and B elementary color points, respectively.

5. The method according to claim 4, wherein chromaticity coordinates ($W_Y'$, Wx', Wy') are the desired chromaticity coordinates specified with respect to the white point in the Yxy color system, $W_R$, $W_G$, $W_B$ are R, G, and B grayscale values of the desired RGB values of the white point, respectively, $M^{-1}$ is the XYZ-RGB conversion matrix, $R\gamma_n$ is a gamma value of a grayscale value n with respect to the elementary color R, $G\gamma_n$ is a gamma value of a grayscale value n with respect to the elementary color G, and $B\gamma_n$ is a gamma value of a grayscale value n with respect to the elementary color B, and wherein calculating the desired RGB values of the white point comprises:

calculating RGB values $\{W_R', W_G', W_B'\}$ in accordance with the following expressions (1a) to (1c):

$$W_X' = W_Y' \times W_x' \div W_y', \tag{1a}$$

$$W_Z' = W_Y' \times (1 - W_x' - W_y') \div W_y', \text{ and} \tag{1b}$$

$$\begin{pmatrix} W_R' \\ W_G' \\ W_B' \end{pmatrix} = M^{-1} \begin{pmatrix} W_X' \\ W_Y' \\ W_Z' \end{pmatrix}; \tag{1c}$$

calculating RGB values $\{W_R^{NRM}, W_G^{NRM}, W_B^{NRM}\}$ by normalizing the RGB values $\{W_R', W_G', W_B'\}$ with an allowed maximum grayscale value;

determining an R grayscale value $W_R$ of the desired RGB values of the white point as a grayscale value n determined such that a value $W_R^{tmp}$ defined by the following expression (2a) is the closest to the R grayscale value $W_R^{NRM}$;

determining an G grayscale value $W_G$ of the desired RGB values of the white point as a grayscale value n determined such that a value $W_G^{tmp}$ defined by the following expression (2b) is the closest to the G grayscale value $W_G^{NRM}$; and determining an B grayscale value $W_B$ of the desired RGB values of the white point as a grayscale value n determined such that a value $W_B^{tmp}$ defined by the following expression (2b) is the closest to the G grayscale value $W_B^{NRM}$:

$$W_R^{tmp} = RGB_{MAX} \times \left(\frac{n}{RGB_{MAX}}\right)^{R\gamma n}, \tag{2a}$$

$$W_G^{tmp} = RGB_{MAX} \times \left(\frac{n}{RGB_{MAX}}\right)^{G\gamma n}, \text{ and} \tag{2b}$$

$$W_B^{tmp} = RGB_{MAX} \times \left(\frac{n}{RGB_{MAX}}\right)^{B\gamma n}. \tag{2c}$$

6. The method according to claim 4, wherein chromaticity coordinates ($R_Y'$, Rx', Ry') are the desired chromaticity coordinates specified with respect to the R elementary color point in the Yxy color system, $R_R$, $R_G$, $R_B$ are R, G and B grayscale values of the desired RGB values of the R elementary color point, respectively, $M^{-1}$ is the XYZ-RGB conversion matrix, $R\gamma_n$ is a gamma value of a grayscale value n with respect to the elementary color R, $G\gamma_n$ is a gamma value of a grayscale value n with respect to the elementary color G, and $B\gamma_n$ is a gamma value of a grayscale value n with respect to the elementary color B, and wherein calculating the desired RGB values of the R elementary color point comprises:

calculating RGB values $\{R_R', R_G', R_B'\}$ in accordance with the following expressions (3a) to (3c):

$$R_X' = R_Y' \times R_x' \div R_y' \tag{3a}$$

$$R_Z' = R_Y' \times (1 - R_x' - R_y') \div R_y', \text{ and} \tag{3b}$$

$$\begin{pmatrix} R_R' \\ R_G' \\ R_B' \end{pmatrix} = M^{-1} \begin{pmatrix} R_X' \\ R_Y' \\ R_Z' \end{pmatrix}; \tag{3c}$$

calculating RGB values $\{R_R^{NRM}, R_G^{NRM}, R_B^{NRM}\}$ by normalizing the RGB values $\{R_R', R_G', R_B'\}$ with an allowed maximum grayscale value;

calculating RGB values $\{R_R'', R_G'', R_B''\}$ by multiplying each of the RGB values $\{R_R^{NRM}, R_G^{NRM}, R_B^{NRM}\}$ by a correction coefficient calculated from a desired relative luminance;

determining an R grayscale value $R_R$ of the desired RGB values of the R elementary color point as a grayscale value n determined such that a value $R_R^{tmp}$ defined by the following expression (4a) is the closest to the R grayscale value $R_R''$;

determining a G grayscale value $R_G$ of the desired RGB values of the R elementary color point as a grayscale value n determined such that a value $R_G^{tmp}$ defined by the following expression (4b) is the closest to the R grayscale value $R_G''$; and determining a B grayscale value $R_B$ of the desired RGB values of the R elementary color point as a grayscale value n determined such that a value $R_B^{tmp}$ defined by the following expression (4c) is the closest to the R grayscale value $R_B''$:

$$R_R^{tmp} = RGB_{MAX} \times \left(\frac{n}{RGB_{MAX}}\right)^{R\gamma n}, \tag{4a}$$

$$R_G^{tmp} = RGB_{MAX} \times \left(\frac{n}{RGB_{MAX}}\right)^{G\gamma n}, \text{ and} \tag{4b}$$

$$R_B^{tmp} = RGB_{MAX} \times \left(\frac{n}{RGB_{MAX}}\right)^{B\gamma n}. \tag{4c}$$

7. The method of claim 1, wherein each of the first luminance coordinate data, the second luminance coordinate data, and the third luminance coordinate data comprises a respective luminance and respective chromaticity coordinates.

8. A color adjustment apparatus for performing color adjustment of a display apparatus including a display device, a color correction circuit, and drive circuitry configured to drive the display device, the apparatus comprising:

a luminance meter configured to measure:

first luminance coordinate data for a color displayed on the display device when image data corresponding to a white point is supplied to the drive circuitry;

second luminance coordinate data for a color displayed on the display device when image data corresponding to a white color of at least one intermediate grayscale value is supplied to the drive circuitry; and third luminance coordinate data for respective colors displayed on the display device when image data corresponding to each of a plurality of elementary color points is supplied to the drive circuitry; and a processing unit configured to:

calculate, based on the first luminance coordinate data and on the second luminance coordinate data, first gamma values for the white color;

calculate, based on the first gamma values and on a conversion matrix indicating a property of the first luminance coordinate data and the third luminance coordinate data, second gamma values for at least one of a plurality of elementary colors;

calculate, using the second gamma values, desired values for displaying the white point and for displaying an adjustment target color; and calculate, based on the first luminance coordinate data, on the second luminance coordinate data, and on the third luminance coordinate data, correction parameters to be set to the color correction circuit, wherein the correction parameters configure the color correction circuit to output the desired values for displaying the white point responsive to the image data corresponding to the white point, and to output the desired values for displaying the adjustment target color responsive to image data corresponding to the adjustment target color.

9. The color adjustment apparatus according to claim 8, wherein the plurality of elementary color points comprises R, G, and B elementary color points, and wherein calculating the desired values comprises calculating desired RGB values of the white point and of the adjustment target color.

10. The color adjustment apparatus according to claim 9, wherein the conversion matrix comprises an XYZ-RGB conversion matrix, wherein calculating the second gamma value comprises calculating gamma values for an elementary color R, gamma values for an elementary color G, and gamma values for an elementary color B, and wherein calculating the desired RGB values of the white point and of the adjustment target color is based on the gamma values for the elementary color R, the gamma values for the elementary color G, and the gamma values for the elementary color B.

11. The color adjustment apparatus according to claim 10, wherein the adjustment target color includes the R, G, and B elementary color points, wherein calculating the desired RGB values of the white point is further based on desired chromaticity coordinates specified with respect to the white point, and wherein the desired RGB values of the R, G, and B elementary color points are calculated based on desired chromaticity coordinates specified for the R, G, and B elementary color points, respectively.

12. The color adjustment apparatus of claim 8, wherein each of the first luminance coordinate data, the second luminance coordinate data, and the third luminance coordinate data comprises a respective luminance and respective chromaticity coordinates.

13. A display driver, comprising:

a drive circuitry configured to drive a display device;

a nonvolatile memory storing:

first luminance coordinate data for a color displayed on the display device when image data corresponding to a white point is supplied to the drive circuitry;

second luminance coordinate data for a color displayed on the display device when image data corresponding to a white color of at least one intermediate grayscale value is supplied to the drive circuitry;

third luminance coordinate data for respective colors displayed on the display device when image data corresponding to each of a plurality of elementary color points is supplied to the drive circuitry; and correction parameters that are based on the first luminance coordinate data, on the second luminance coordinate data, and on the third luminance coordinate data; and a color correction circuit configured to output, based on the correction parameters, desired values to the drive circuitry for displaying the white point responsive to the image data corresponding to the white point, and for displaying an adjustment target color responsive to image data corresponding to the adjustment target color, wherein the desired values are based on first gamma values for at least one of a plurality of elementary colors, wherein the first gamma values are based on second gamma values for the white color and on a conversion matrix indicating a property of the first luminance coordinate data and the third luminance coordinate data, wherein the second gamma values are based on the first luminance data and on the second luminance data.

14. The display driver of claim 13, wherein the plurality of elementary color points comprises R, G, and B elementary color points, and wherein calculating the desired values comprises calculating desired RGB values of the white point and of the adjustment target color.

15. The display driver of claim 14, wherein the conversion matrix comprises an XYZ-RGB conversion matrix, wherein calculating the second gamma values comprises calculating gamma values for an elementary color R, gamma values for an elementary color G, and gamma values for an elementary color B, and wherein calculating the desired RGB values of the white point and of the adjustment target color is based on the gamma values for the elementary color R, the gamma values for the elementary color G, and the gamma values for the elementary color B.

16. The display driver of claim 15, wherein the adjustment target color includes the R, G, and B elementary color points, wherein calculating the desired RGB values of the white point is further based on desired chromaticity coordinates specified with respect to the white point, and wherein the desired RGB values of the R, G, and B elementary color points are calculated based on desired chromaticity coordinates specified for the R, G, and B elementary color points, respectively.

17. A display system, comprising:

a display apparatus including a display device and a display driver comprising:

a color correction circuit;

a drive circuitry configured to drive the display device; and a nonvolatile memory storing:

first luminance coordinate data for a color displayed on the display device when image data corresponding to a white point is supplied to the drive circuitry;

second luminance coordinate data for a color displayed on the display device when image data corresponding to a white color of at least one intermediate grayscale value is supplied to the drive circuitry; and third luminance coordinate data for respective colors displayed on the display device when image data corresponding to each of a plurality of elementary color points is supplied to the drive circuitry;

a host configured to:

receive the first luminance coordinate data, the second luminance coordinate data, and the third luminance coordinate data from the display driver;

calculate, based on the first luminance coordinate data and on the second luminance coordinate data, first gamma values for the white color;

calculate, based on the first gamma values and on a conversion matrix indicating a property of the first luminance coordinate data and the third luminance coordinate data, second gamma values for at least one of a plurality of elementary colors;

calculate, using the second gamma values, desired values for displaying the white point and for displaying an adjustment target color;

calculate, based on the first luminance coordinate data, on the second luminance coordinate data, and on the third luminance coordinate data, correction parameters that configure the color correction circuit to output the desired values for displaying the white point responsive to the image data corresponding to the white point, and to output the desired values for displaying the adjustment target color responsive to image data corresponding to the adjustment target color; and transfer the correction parameters to the display driver.

18. The display system according to claim 17, wherein the plurality of elementary color points comprises R, G, and B elementary color points, and wherein calculating the desired values comprises calculating desired RGB values of the white point and of the adjustment target color.

19. The display system according to claim 18, wherein the conversion matrix comprises an XYZ-RGB conversion matrix;

wherein calculating the second gamma values for an elementary color R, gamma values for an elementary color G, and gamma values for an elementary color B, and wherein calculating the desired RGB values of the white point and of the adjustment target color is based on the gamma values for the elementary color R, the gamma values for the elementary color G, and the gamma values for the elementary color B.

20. The display system according to claim 19, wherein the adjustment target color includes the R, G, and B elementary color points, wherein calculating the desired RGB values of the white point is further based on desired chromaticity coordinates specified with respect to the white point, and wherein the desired RGB values of the R, G, and B elementary color points are calculated based on desired chromaticity coordinates specified for the R, G, and B elementary color points, respectively.

* * * * *